US007620554B2

(12) United States Patent
Ojanperä

(10) Patent No.: US 7,620,554 B2
(45) Date of Patent: Nov. 17, 2009

(54) MULTICHANNEL AUDIO EXTENSION

(75) Inventor: Juha Ojanperä, Nokia (FI)

(73) Assignee: Nokia Corporation, Espoo (FI)

( * ) Notice: Subject to any disclaimer, the term of this patent is extended or adjusted under 35 U.S.C. 154(b) by 782 days.

(21) Appl. No.: 11/138,711

(22) Filed: May 26, 2005

(65) Prior Publication Data

US 2005/0267763 A1 Dec. 1, 2005

(30) Foreign Application Priority Data

May 28, 2004 (WO) ..... PCT/IB2004/001764

(51) Int. Cl.

| | |
|---|---|
| ***G10L 19/00*** | (2006.01) |
| ***G10L 19/02*** | (2006.01) |
| ***G10L 19/14*** | (2006.01) |
| ***H04R 5/00*** | (2006.01) |

(52) U.S. Cl. ..... 704/500; 704/203; 704/205; 381/17; 381/22; 381/23

(58) Field of Classification Search ..... 704/229
See application file for complete search history.

(56) References Cited

U.S. PATENT DOCUMENTS

| | | | | |
|---|---|---|---|---|
| 4,516,258 | A * | 5/1985 | Ching et al. | 704/229 |
| 5,539,829 | A | 7/1996 | Lokhoff et al. | |
| 5,606,618 | A | 2/1997 | Lokhoff et al. | |
| 6,016,473 | A | 1/2000 | Dolby | |
| 6,064,954 | A * | 5/2000 | Cohen et al. | 704/207 |
| 6,691,082 | B1 * | 2/2004 | Aguilar et al. | 704/219 |
| 7,116,787 | B2 * | 10/2006 | Faller | 381/17 |
| 7,382,886 | B2 * | 6/2008 | Henn et al. | 381/23 |
| 2002/0009000 | A1 * | 1/2002 | Goldberg et al. | 365/200 |
| 2003/0142746 | A1 | 7/2003 | Tanaka et al. | |
| 2003/0219130 | A1 * | 11/2003 | Baumgarte et al. | 381/17 |
| 2003/0231774 | A1 | 12/2003 | Schildbach et al. | |
| 2004/0064311 | A1 | 4/2004 | Sinha et al. | |
| 2005/0078832 | A1 * | 4/2005 | Van De Par et al. | 381/17 |
| 2005/0177360 | A1 * | 8/2005 | Schuijers et al. | 704/201 |

FOREIGN PATENT DOCUMENTS

| | | |
|---|---|---|
| WO | 03/007656 | 1/2003 |

OTHER PUBLICATIONS

Schuijers, E. et al. "Low Complexity Parametric Stereo Coding," 116th Convention of Audio Engineering Society, May 8-11, 2004.*

(Continued)

*Primary Examiner*—Matthew J Sked

(57) ABSTRACT

A method is shown for supporting a multichannel audio extension at an encoding end of a multichannel audio coding system. In order to improve the audio quality over a large frequency range, the method comprises transforming each channel of a multichannel audio signal into the frequency domain and dividing a bandwidth of the frequency domain signals into a first region of lower frequencies and at least one further region of higher frequencies. Then, the frequency domain signals are encoded in each of the frequency regions with another type of coding to obtain parametric multichannel extension information for the respective frequency region. The invention relates equally to a method for supporting in a corresponding manner a multichannel audio extension at a decoding end. Also shown are a corresponding encoder, a corresponding decoder, and corresponding devices, systems and software program products.

29 Claims, 12 Drawing Sheets

OTHER PUBLICATIONS

3GPP TS 26.405 V1.0.0 (May 2004), 3rd Generation Partnership Project; Technical Specification Group Services and System Aspects; General Audio Codec audio processing functions; Enhanced aacPlus general audio codec; Encoder Specification Parametric Stereo part (Release 6).

"Advances in Parametric Coding for High-Quality Audio" by E. Schuijers et al, Nov. 15, 2002, pp. 73-79.

"Sum-Difference Stereo Transform Coding" by J.D. Johnston et al, ICASSP-92 Conference Record, 1992, pp. 569-572.

"Why Binaural Cue Coding is better than Intensity Stereo Coding" by F. Baumgarte et al, AES112th Convention, May 10-13, 2002, pp. 1-10.

"Text of ISO/IEC 14496-3:2001/FPDAM 1, Bandwidth Extension" N5203, Oct. 2002.

"Analysis/synthesis Filter Bank Design Based on Time Domain Aliasing Cancellation", IEEE Trans. Acoustics, Speech, and Signal Processing, 1986, vol. ASSP-34, No. 5, Oct. 1986, pp. 1153-1161.

"The Modulated Lapped Transform, Its Time-Varying Forms, and Its Applications to Audio Coding Standards" by S. Shlien, IEEE Trans. Speech, and Audio Processing, vol. 5, No. 4, Jul. 1997, pp. 359-366.

* cited by examiner

Huffman scheme 1:

```
hIndexTable[25][2] = {
{1,   0}, {3,   6}, {6,  38}, {6,  32}, {8, 245}, {3,   5}, {4,  14}, {6,  62}, {7,  75},
{8, 157}, {5,  17}, {6,  63}, {6,  33}, {7,  72}, {8, 156}, {7, 123}, {7,  74}, {7,  73},
{8, 159}, {8, 158}, {8, 244}, {8, 241}, {8, 240}, {8, 243}, {8, 242}};
```

Huffman scheme 2:

```
hIndexTable [25][2] = {
{1,   1}, {3,   3}, {5,   6}, {7,  13}, {7,  12}, {3,   2}, {4,   2}, {7,  14}, {7,   5},
{7,   4}, {6,  14}, {7,  30}, {7,  15}, {7,   7}, {7,   6}, {7,   1}, {7,   0}, {7,   3},
{7,   2}, {8,  63}, {7,   8}, {7,   9}, {7,  10}, {8,  62}, {7,  11}};
```

Huffman scheme 3:

```
hIndexTable [25][2] = {
{1,   0}, {4,  13}, {5,  24}, {6,  36}, {8, 191}, {4,  15}, {4,  10}, {5,  25}, {7,  94},
{8, 234}, {4,   8}, {5,  28}, {5,  22}, {6,  39}, {7,  92}, {7, 119}, {7, 118}, {6,  38},
{7, 116}, {7,  75}, {8, 190}, {8, 187}, {7,  74}, {8, 235}, {8, 186}};
```

Fig. 8

Huffman scheme 4:

```
hIndexTable [25][2] = {
{4,   9}, {3,   6}, {4,   3}, {6,   2}, {8,  174}, {3,   7}, {2,   1}, {5,  23}, {6,  42},
{7,  68}, {5,  20}, {4,   1}, {4,   2}, {6,   44}, {7,  71}, {6,   3}, {6,  33}, {6,  45},
{6,  32}, {7,  70}, {8,  175}, {7,  69}, {6,   1}, {6,   0}, {7,  86}};
```

Huffman scheme 5:

```
hIndexTable [81][2]= {
{2,   1}, {3,   5}, {4,   8}, {7,  125}, {8,  247}, {9,  301}, {9,  300}, {9,  303}, {9,  302},
{3,   6}, {3,   1}, {5,   0}, {6,   2}, {8,   14}, {9,  485}, {9,  484}, {9,  487}, {9,  486},
{4,   1}, {6,  63}, {7,  122}, {8,  148}, {9,  481}, {9,  480}, {9,  483}, {9,  482}, {9,  309},
{6,  36}, {7,  124}, {8,  246}, {9,  308}, {9,  311}, {9,  310}, {9,  305}, {9,  304},
{9,  307}, {7,   6}, {8,   15}, {9,  306}, {9,  317}, {9,  316}, {9,  319}, {9,  318}, {9,  313},
{9,  312}, {9,  315}, {9,  314}, {9,  469}, {9,  468}, {9,  471}, {9,  470}, {9,  465},
{9,  464}, {9,  467}, {9,  466}, {9,  477}, {9,  476}, {9,  479}, {9,  478}, {9,  473},
{9,  472}, {9,  475}, {9,  474}, {9,  453}, {9,  452}, {9,  455}, {9,  454}, {9,  449},
{9,  448}, {9,  451}, {9,  450}, {9,  461}, {9,  460}, {9,  463}, {9,  462},
{9,  457}, {9,  456}, {9,  459}, {9,  458}, {9,  299}, {9,  298}};
```

Fig. 9

Huffman scheme 6:

```
hIndexTable [81][2] = {
{2,  3}, {3,  4}, {4,  0}, {7,  15}, { 4, 8,  29}, {9,  341}, {9,  340}, {9,  343}, {9,  342},
{3,  2}, {3,  1}, {5,  2}, {7,  12}, {9,  337}, {9,  336}, {9,  339}, {9,  338},
{9,  349}, {4,  7}, {5,  12}, {6,  26}, {8,  108}, {9,  348}, {9,  351}, {9,  350},
{9,  345}, {9,  344}, {7,  55}, {7,  13}, {8,  28}, {9,  347}, {9,  346}, {9,  325},
{9,  324}, {9,  327}, {9,  326}, {8,  109}, {9,  321}, {9,  320}, {9,  323}, {9,  322},
{9,  333}, {9,  332}, {9,  335}, {9,  334}, {9,  329}, {9,  328}, {9,  331}, {9,  330},
{9,  373}, {9,  372}, {9,  375}, {9,  374}, {9,  369}, {9,  368}, {9,  371}, {9,  370},
{9,  381}, {9,  380}, {9,  383}, {9,  382}, {9,  377}, {9,  376}, {9,  379}, {9,  378},
{9,  357}, {9,  356}, {9,  359}, {9,  358}, {9,  353}, {9,  352}, {9,  355}, {9,  354},
{9,  365}, {9,  364}, {9,  367}, {9,  366}, {9,  361}, {9,  360}, {9,  363}, {9,  362}};
```

Huffman scheme 7:

```
hIndexTable [81][2] = {
{4,  14}, {3,  2}, {4,  6}, {6,  4}, {7,  10}, {9,  437}, {9,  436}, {9,  421}, {9,  420},
{3,  1}, {3,  4}, { 11, 4,  10}, 6,  55}, {7,  14}, {9,  423}, {9,  422}, {9,  417},
{9,  416}, {4,  0}, {4,  7}, {5,  30}, {6,  62}, {7,  89}, {9,  419}, {9,  418}, {9,  405},
{9,  404}, {6,  6}, {6,  46}, {6,  63}, {6,  53}, {7,  15}, {9,  407}, {9,  406}, {9,  401},
{9,  400}, {8,  219}, {7,  11}, {7,  91}, {7,  88}, {8,  180}, {9,  403}, {9,  402}, {9,  413},
{9,  412}, {9,  415}, {9,  414}, {9,  409}, {9,  408}, {9,  411}, {9,  410}, {9,  389},
{9,  388}, {9,  391}, {9,  390}, {9,  385}, {9,  384}, {9,  387}, {9,  386}, {9,  397},
{9,  396}, {9,  399}, {9,  398}, {9,  393}, {9,  392}, {9,  395}, {9,  394}, {9,  381},
{9,  380}, {9,  383}, {9,  382}, {9,  377}, {9,  376}, {9,  379}, {9,  378}, {9,  433},
{9,  432}, {9,  435}, {9,  434}, {9,  363}, {9,  362}};
```

Fig. 10

Huffman scheme 8:

```
hIndexTable [81][2] = {
{3,  3}, {3,  6}, {4,  1}, {7,  124}, {8,  182}, {9,  485}, {9,  484}, {9,  373}, {9,  372},
{3,  4}, {3,  2}, {4,  10}, {7,  127}, {8,  244}, {9,  375}, {9,  374}, {9,  369},
{9,  368}, {4,  0}, {4,  2}, {5,  7}, {6,  12}, {8,  181}, {9,  371}, {9,  370},
{9,  381}, {9,  380}, {7,  123}, {7,  126}, {6,  44}, {6,  13}, {8,  250}, {9,  383}, {9,  382},
{9,  377}, {9,  376}, {9,  503}, {8,  180}, {8,  243}, {8,  245}, {9,  502}, {9,  379},
{9,  378}, {9,  469}, {9,  468}, {9,  471}, {9,  470}, {9,  465}, {9,  464}, {9,  467},
{9,  466}, {9,  477}, {9,  476}, {9,  479}, {9,  478}, {9,  473}, {9,  472}, {9,  475},
{9,  474}, {9,  453}, {9,  452}, {9,  455}, {9,  454}, {9,  449}, {9,  448}, {9,  451},
{9,  450}, {9,  461}, {9,  460}, {9,  463}, {9,  462}, {9,  457}, {9,  456}, {9,  459},
{9,  458}, {9,  481}, {9,  480}, {9,  483}, {9,  482}, {9,  367}, {9,  366}};
```

Fig. 11

MULTICHANNEL AUDIO EXTENSION

FIELD OF THE INVENTION

The invention relates to a method for supporting a multichannel audio extension at an encoding end of a multichannel audio coding system. The invention relates equally to a method for supporting a multichannel audio extension at a decoding end of a multichannel audio coding system. The invention relates equally to a corresponding encoder, to a corresponding decoder, and to corresponding devices, systems and software program products.

BACKGROUND OF THE INVENTION

Audio coding systems are known from the state of the art. They are used in particular for transmitting or storing audio signals.

FIG. 1 shows the basic structure of an audio coding system, which is employed for transmission of audio signals. The audio coding system comprises an encoder 10 at a transmitting side and a decoder 11 at a receiving side. An audio signal that is to be transmitted is provided to the encoder 10. The encoder is responsible for adapting the incoming audio data rate to a bitrate level at which the bandwidth conditions in the transmission channel are not violated. Ideally, the encoder 10 discards only irrelevant information from the audio signal in this encoding process. The encoded audio signal is then transmitted by the transmitting side of the audio coding system and received at the receiving side of the audio coding system. The decoder 11 at the receiving side reverses the encoding process to obtain a decoded audio signal with little or no audible degradation.

Alternatively, the audio coding system of FIG. 1 could be employed for archiving audio data. In that case, the encoded audio data provided by the encoder 10 is stored in some storage unit, and the decoder 11 decodes audio data retrieved from this storage unit. In this alternative, it is the target that the encoder achieves a bitrate which is as low as possible, in order to save storage space.

The original audio signal which is to be processed can be a mono audio signal or a multichannel audio signal containing at least a first and a second channel signal. An example of a multichannel audio signal is a stereo audio signal, which is composed of a left channel signal and a right channel signal.

Depending on the allowed bitrate, different encoding schemes can be applied to a stereo audio signal. The left and right channel signals can be encoded for instance independently from each other. But typically, a correlation exists between the left and the right channel signals, and the most advanced coding schemes exploit this correlation to achieve a further reduction in the bitrate.

Particularly suited for reducing the bitrate are low bitrate stereo extension methods. In a stereo extension method, the stereo audio signal is encoded as a high bitrate mono signal, which is provided by the encoder together with some side information reserved for a stereo extension. In the decoder, the stereo audio signal is then reconstructed from the high bitrate mono signal in a stereo extension making use of the side information. The side information typically takes only a few kbps of the total bitrate.

If a stereo extension scheme aims at operating at low bitrates, an exact replica of the original stereo audio signal cannot be obtained in the decoding process. For the thus required approximation of the original stereo audio signal, an efficient coding model is necessary.

The most commonly used stereo audio coding schemes are Mid Side (MS) stereo and Intensity Stereo (IS).

In MS stereo, the left and right channel signals are transformed into sum and difference signals, as described for example by J. D. Johnston and A. J. Ferreira in "Sum-difference stereo transform coding", ICASSP-92 Conference Record, 1992, pp. 569-572. For a maximum coding efficiency, this transformation is done in both a frequency and a time dependent manner. MS stereo is especially useful for high quality, high bitrate stereophonic coding.

In the attempt to achieve lower bitrates, IS has been used in combination with this MS coding, where IS constitutes a stereo extension scheme. In IS coding, a portion of the spectrum is coded only in mono mode, and the stereo audio signal is reconstructed by providing in addition different scaling factors for the left and right channels, as described for instance in documents U.S. Pat. No. 5,539,829 and U.S. Pat. No. 5,606,618.

Two further, very low bitrate stereo extension schemes have been proposed with Binaural Cue Coding (BCC) and Bandwidth Extension (BWE). In BCC, described by F. Baumgarte and C. Faller in "Why Binaural Cue Coding is Better than Intensity Stereo Coding, AES112th Convention, May 10-13, 2002, Preprint 5575, the whole spectrum is coded with IS. In BWE coding, described in ISO/IEC JTC1/SC29/WG11 (MPEG-4), "Text of ISO/IEC 14496-3:2001/FPDAM 1, Bandwidth Extension", N5203 (output document from MPEG 62nd meeting), October 2002, a bandwidth extension is used to extend the mono signal to a stereo signal.

Moreover, document U.S. Pat. No. 6,016,473 proposes a low bit-rate spatial coding system for coding a plurality of audio streams representing a soundfield. On the encoder side, the audio streams are divided into a plurality of subband signals, representing a respective frequency subband. Then, a composite signal representing the combination of these subband signals is generated. In addition, a steering control signal is generated, which indicates the principal direction of the soundfield in the subbands, e.g. in the form of weighted vectors. On the decoder side, an audio stream in up to two channels is generated based on the composite signal and the associated steering control signal.

SUMMARY OF THE INVENTION

It is an object of the invention to provide a side information which allows extending a mono audio signal to a multichannel audio signal having a high quality. It is equally an object of the invention to enable a use such a side information for extending a mono audio signal to a multichannel audio signal having a high quality.

A method for supporting a multichannel audio extension at an encoding end of a multichannel audio coding system is proposed. This encoding method comprises transforming each channel of a multichannel audio signal into the frequency domain. The encoding method further comprises dividing a bandwidth of the frequency domain signals into a first region of lower frequencies and at least one further region of higher frequencies. The encoding method further comprises encoding the frequency domain signals in each of the frequency regions with another type of coding to obtain a parametric multichannel extension information for the respective frequency region.

Correspondingly, a method for supporting a multichannel audio extension at a decoding end of a multichannel audio coding system is proposed. This decoding method comprises decoding an encoded parametric multichannel extension information which is provided separately for a first region of lower frequencies and for at least one further region of higher frequencies using different types of coding. The decoding method further comprises reconstructing a multichannel signal out of an available mono signal based on the decoded parametric multichannel extension information separately for the first region and the at least one further region. The decoding method further comprises combining the reconstructed multichannel signals in the first and the at least one further region. The decoding method further comprises transforming each channel of the combined multichannel signal into the time domain.

Moreover, an encoder for supporting a multichannel audio extension at an encoding end of a multichannel audio coding system is proposed. The encoder comprises a transforming portion adapted to transform each channel of a multichannel audio signal into the frequency domain. The encoder further comprises a separation portion adapted to divide a bandwidth of frequency domain signals provided by the transforming portion into a first region of lower frequencies and at least one further region of higher frequencies. The encoder further comprises a low frequency encoder adapted to encode frequency domain signals provided by the separation portion for the first frequency region with a first type of coding to obtain a parametric multichannel extension information for the first frequency region. The encoder further comprises at least one higher frequency encoder adapted to encode frequency domain signals provided by the separation portion for the at least one further frequency region with at least one further type of coding to obtain a parametric multichannel extension information for the at least one further frequency region.

Correspondingly, a decoder for supporting a multichannel audio extension at a decoding end of a multichannel audio coding system is proposed. The decoder comprises a processing portion which is adapted to process encoded parametric multichannel extension information provided separately for a first region of lower frequencies and for at least one further region of higher frequencies. The processing portion includes a first decoding portion adapted to decode an encoded parametric multichannel extension information which is provided for the first region using a first type of coding, and to reconstruct a multichannel signal out of an available mono signal based on the decoded parametric multichannel extension information. The processing portion further includes at least one further decoding portion adapted to decode an encoded parametric multichannel extension information which is provided for the at least one further region using at least one further type of coding, and to reconstruct a multichannel signal out of an available mono signal based on the decoded parametric multichannel extension information. The processing portion further includes a combining portion adapted to combine reconstructed multichannel signals provided by the first decoding portion and the at least one further decoding portion. The processing portion further includes a transforming portion adapted to transform each channel of a combined multichannel signal into a time domain.

Moreover, an electronic device comprising the proposed encoder and/or the proposed decoder is proposed, as well as an audio coding system comprising an electronic device with such an encoder and an electronic device with such a decoder.

Moreover, a software program product is proposed, in which a software code for supporting a multichannel audio extension at an encoding end of a multichannel audio coding system is stored. When running in a processing component of an encoder, the software code realizing the proposed encoding method.

Finally, a software program product is proposed, in which a software code for supporting a multichannel audio extension at a decoding end of a multichannel audio coding system is stored. When running in a processing component of a decoder, the software code realizing the proposed decoding method.

The invention proceeds from the idea that when applying the same coding scheme across the full bandwidth of a multichannel audio signal, for example separately for various frequency bands, the resulting frequency response may not match the requirements for good stereo quality for the entire bandwidth. In particular, coding schemes which are efficient for middle and high frequencies might not be appropriate for low frequencies, and vice versa.

It is therefore proposed that a multichannel signal is transformed into the frequency domain, divided into at least two frequency regions, and encoded with different coding schemes for each region.

It is an advantage of the invention that it enables an efficient coding of multichannel parameters at different frequencies, for example separately at low frequencies, middle frequencies and high frequencies. As a result, also an improved reconstruction of a multichannel signal from a mono signal is enabled.

Preferred embodiments of the invention become apparent from the detailed description below.

For a low frequency region, the samples of all channels are advantageously combined, quantized and encoded.

The encoding may be based on one of a plurality of selectable coding schemes, of which the one resulting in the lowest bit consumption is selected. The coding schemes can be in particular Huffman coding schemes. Any other entropy coding schemes could be used as well, though.

If the number of resulting bits is nevertheless too high, the quantized samples can be modified such that a lower bit consumption can be achieved in the encoding.

On the other hand, if the number of resulting bits is too low, a corresponding number of refinement bits can be generated and provided, which allow compensation for quantization errors.

The quantization gain which is employed for the quantization can be selected separately for each frame. Advantageously, however, the quantization gains employed for surrounding frames are taken account of as well in order to avoid sudden changes from frame to frame, as this might be noticeable in the decoded signal.

In addition to the low frequency region, one or more higher frequency regions can be dealt with separately. In one embodiment of the invention, a middle frequency region and a high frequency region are considered in addition to the low frequency region.

The samples in the middle frequency region can be encoded for example by determining for each of a plurality of adjacent frequency bands whether a spectral first channel signal of the multichannel signal, a spectral second channel signal of the multichannel signal or none of the spectral channel signals is dominant in the respective frequency band. Then, a corresponding state information may be encoded for each of the frequency bands as a parametric multichannel extension information.

Advantageously, the determined state information is post-processed before encoding, though. The post-processing ensures that short-time changes in the state information are avoided.

The samples in the high frequency region can be encoded for instance in a first approach in the same way as the samples in the middle frequency region. In addition, a further approach might be defined. It may then be decided for each frame whether the first approach or the second approach is to be used, depending on the associated bit consumption. The second approach may include for example comparing the state information for a current frame to state information for a previous frame. If there was no change, only this information has to be provided. Otherwise, the actual state information for the current frame is encoded in addition.

The invention can be used with various codecs, in particular, though not exclusively, with Adaptive Multi-Rate Wideband extension (AMR-WB+), which is suited for high audio quality.

The invention can further be implemented either in software or using a dedicated hardware solution. Since the enabled multichannel audio extension is part of an audio coding system, it is preferably implemented in the same way as the overall coding system. It has to be noted, however, that it is not required that a coding scheme employed for coding a mono signal uses the same frame length as the stereo extension. The mono coder is allowed to use any frame length and coding scheme as is found appropriate.

The invention can be employed in particular for storage purposes and for transmissions, for instance to and from mobile terminals.

BRIEF DESCRIPTION OF THE FIGURES

Other objects and features of the present invention will become apparent from the following detailed description considered in conjunction with the accompanying drawings.

FIG. 8 is a diagram presenting tables for Huffman schemes 1, 2 and 3;

FIG. 9 is a diagram presenting tables for Huffman schemes 4 and 5;

FIG. 10 is a diagram presenting tables for Huffman schemes 6 and 7;

FIG. 11 is a diagram presenting a table for Huffman schemes 8; and

DETAILED DESCRIPTION OF THE INVENTION

Figure 1:
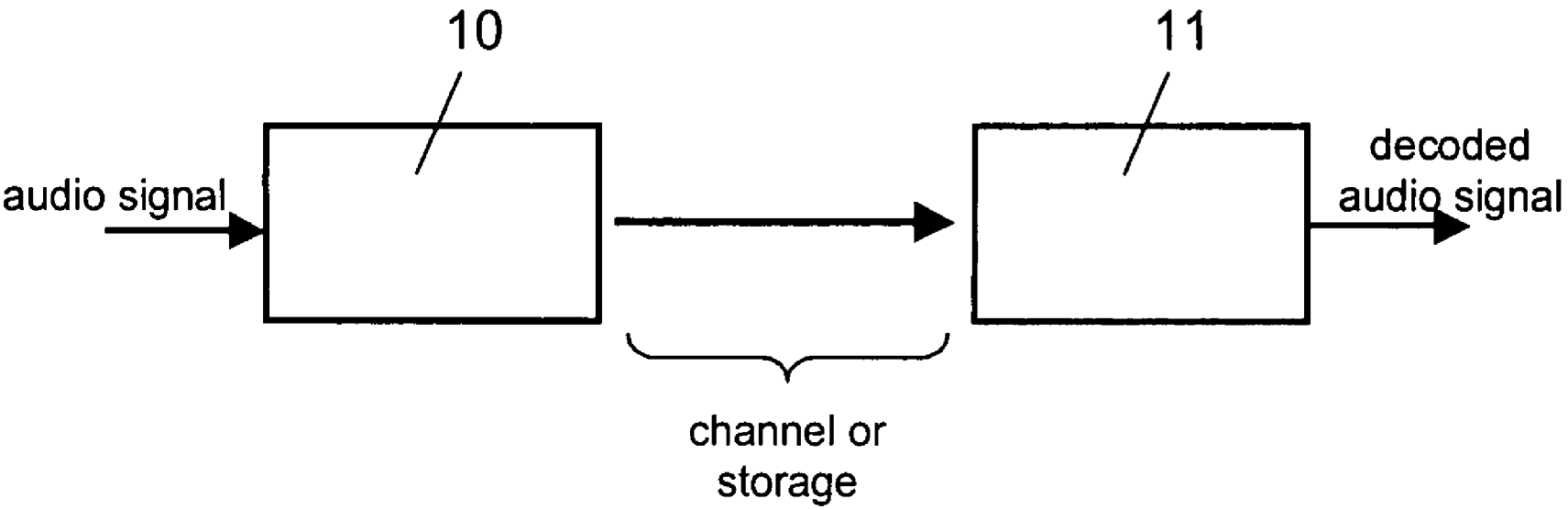
FIG. 1 is a block diagram presenting the general structure of an audio coding system.

FIG. 1 has already been described above.

Figure 2:
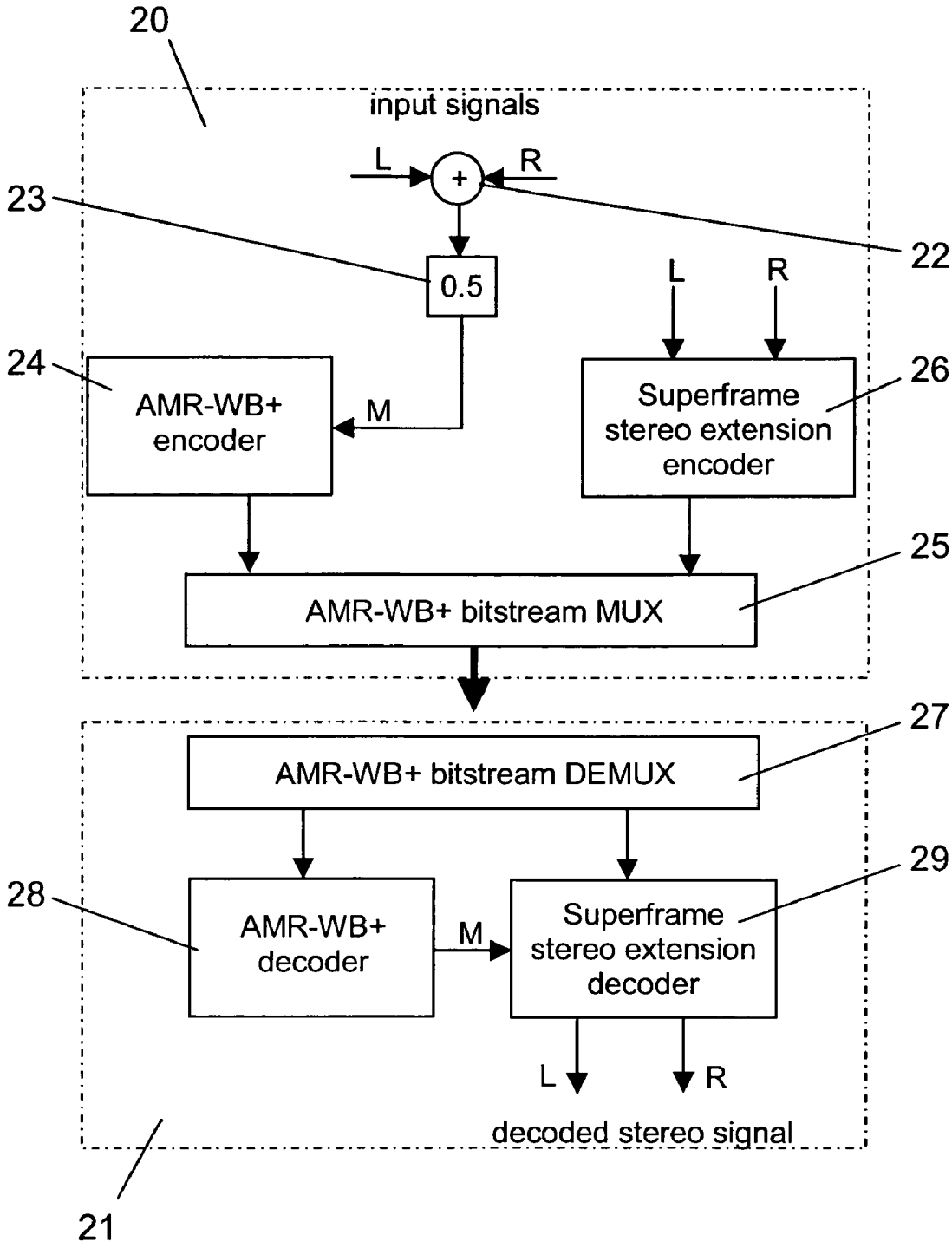
FIG. 2 is a high level block diagram of a stereo audio coding system in which an embodiment of the invention can be implemented.

FIG. 2 presents the general structure of a stereo audio coding system, in which the invention can be implemented. The stereo audio coding system can be employed for transmitting a stereo audio signal which is composed of a left channel signal and a right channel signal. All details which will be given by way of example are valid for stereo signals which are sampled at 32 kHz.

The stereo audio coding system of FIG. 2 comprises a stereo encoder 20 and a stereo decoder 21. The stereo encoder 20 encodes stereo audio signals and transmits them to the stereo decoder 21, while the stereo decoder 21 receives the encoded signals, decodes them and makes them available again as stereo audio signals. Alternatively, the encoded stereo audio signals could also be provided by the stereo encoder 20 for storage in a storing unit, from which they can be extracted again by the stereo decoder 21.

The stereo encoder 20 comprises a summing point 22, which is connected via a scaling unit 23 to an AMR-WB+ mono encoder component 24. The AMR-WB+ mono encoder component 24 is further connected to an AMR-WB+ bitstream multiplexer (MUX) 25. In addition, the stereo encoder 20 comprises a superframe stereo extension encoder 26, which is equally connected to the AMR-WB+ bitstream multiplexer 25.

The stereo decoder 21 comprises an AMR-WB+ bitstream demultiplexer (DEMUX) 27, which is connected on the one hand to an AMR-WB+ mono decoder component 28 and on the other hand to a stereo extension decoder 29. The AMR-WB+ mono decoder component 28 is further connected to the superframe stereo extension decoder 29.

When a stereo audio signal is to be transmitted, the left channel signal L and the right channel signal R of the stereo audio signal are provided to the stereo encoder 20. The left channel signal L and the right channel signal R are assumed to be arranged in frames.

The left and right channel signals L, R are summed by the summing point 22 and scaled by a factor 0.5 in the scaling unit 23 to form a mono audio signal M. The AMR-WB+ mono encoder component 24 is then responsible for encoding the mono audio signal in a known manner to obtain a mono signal bitstream.

The left and right channel signals L, R provided to the stereo encoder 20 are processed in addition in the superframe stereo extension encoder 26, in order to obtain a bitstream containing side information for a stereo extension.

The bitstreams provided by the AMR-WB+ mono encoder component 24 and the superframe stereo extension encoder 26 are multiplexed by the AMR-WB+ bitstream multiplexer 25 for transmission.

The transmitted multiplexed bitstream is received by the stereo decoder 21 and demultiplexed by the AMR-WB+ bitstream demultiplexer 27 into a mono signal bitstream and a side information bitstream again. The mono signal bitstream is forwarded to the AMR-WB+ mono decoder component 28 and the side information bitstream is forwarded to the superframe stereo extension decoder 29.

The mono signal bitstream is then decoded in the AMR-WB+ mono decoder component 28 in a known manner. The resulting mono audio signal M is provided to the superframe stereo extension decoder 29. The superframe stereo extension decoder 29 decodes the bitstream containing the side information for the stereo extension and extends the received mono audio signal M based on the obtained side information into a left channel signal L and a right channel signal R. The left and right channel signals L, R are then output by the stereo decoder 21 as reconstructed stereo audio signal.

The superframe stereo extension encoder 26 and the superframe stereo extension decoder 29 are designed according to an embodiment of the invention, as will be explained in the following.

Figure 3:
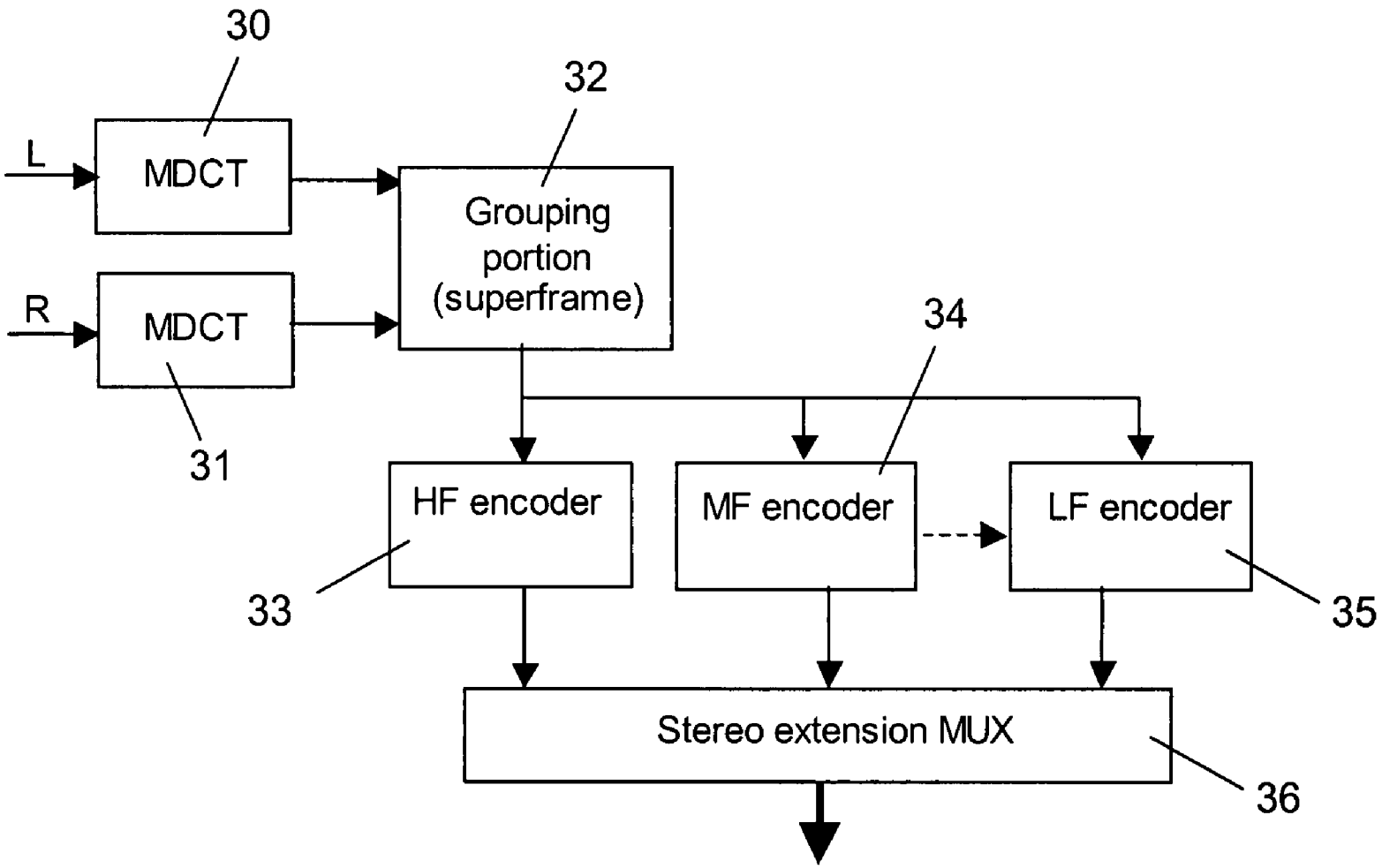
FIG. 3 is a high level block diagram of an embodiment of a superframe stereo extension encoder in accordance with the invention in the system of FIG. 2.

The structure of the superframe stereo extension encoder 26 is illustrated in more detail in FIG. 3.

The superframe stereo extension encoder 26 comprises a first Modified Discrete Cosine Transform (MDCT) portion 30 and a second MDCT portion 31. Both are connected to a grouping portion 32. The grouping portion 32 is further connected to a high frequency (HF) encoding portion 33, to a middle frequency (MF) encoding portion 34 and to a low frequency (LF) encoding portion 35. The output of all three encoding portions 33 to 35 is connected to a stereo extension multiplexer MUX 36.

A received left channel signal L is transformed by the MDCT portion 30 by means of a frame based MDCT into the frequency domain, resulting in a spectral channel signal. In parallel, a received right channel signal R is transformed by the MDCT portion 31 by means of a frame based MDCT into the frequency domain, resulting in a spectral channel signal. The MDCT has been described in detail for instance by J. P. Princen, A. B. Bradley in "Analysis/synthesis filter bank design based on time domain aliasing cancellation", IEEE Trans. Acoustics, Speech, and Signal Processing, 1986, Vol. ASSP-34, No. 5, October 1986, pp. 1153-1161, and by S. Shlien in "The modulated lapped transform, its time-varying forms, and its applications to audio coding standards", IEEE Trans. Speech, and Audio Processing, Vol. 5, No. 4, July 1997, pp. 359-366.

The grouping portion 32 then groups the frequency domain signals of a certain number of successive frames to form a superframe, which is further processed as one entity. A superframe may comprise for example four successive frames of 20 ms.

Thereafter, the frequency spectra of a superframe is divided into three spectral regions, namely into an HF region, an MF region and an LF region. The LF region covers spectral frequencies from 0 Hz to 800 Hz, including frequency bins 0 to 31. The MF region covers spectral frequencies from 800 Hz to 6.05 kHz, including frequency bins 32 to 241. The HF region covers spectral frequencies from 6.05 kHz to 16 kHz, beginning with a frequency bin 242. The respective first frequency bin in a region will be referred to as startBin. The HF region is dealt with by the HF encoder 33, the MF region is dealt with by the MF encoder 34 and the LF region is dealt with by the LF encoder 35. Each encoding portion 33, 34, 35 applies a dedicated extension coding scheme in order to obtain stereo extension information for the respective frequency region. The frame size for the stereo extension is 20 ms, which corresponds to 640 samples. The bitrate for the stereo extension is 6.75 kbps. Thus, the total number of bits which is available for the stereo extension information for each superframe is:

$$\text{bits_available} = \frac{6750}{32000} \cdot 640 \cdot 4 = 540 \text{ bits} \tag{1}$$

The stereo extension information generated by the encoding portion 33, 34, 35 is then multiplexed by the stereo extension multiplexer 36 for provision to the AMR-WB+ bitstream multiplexer 25.

Figure 4:
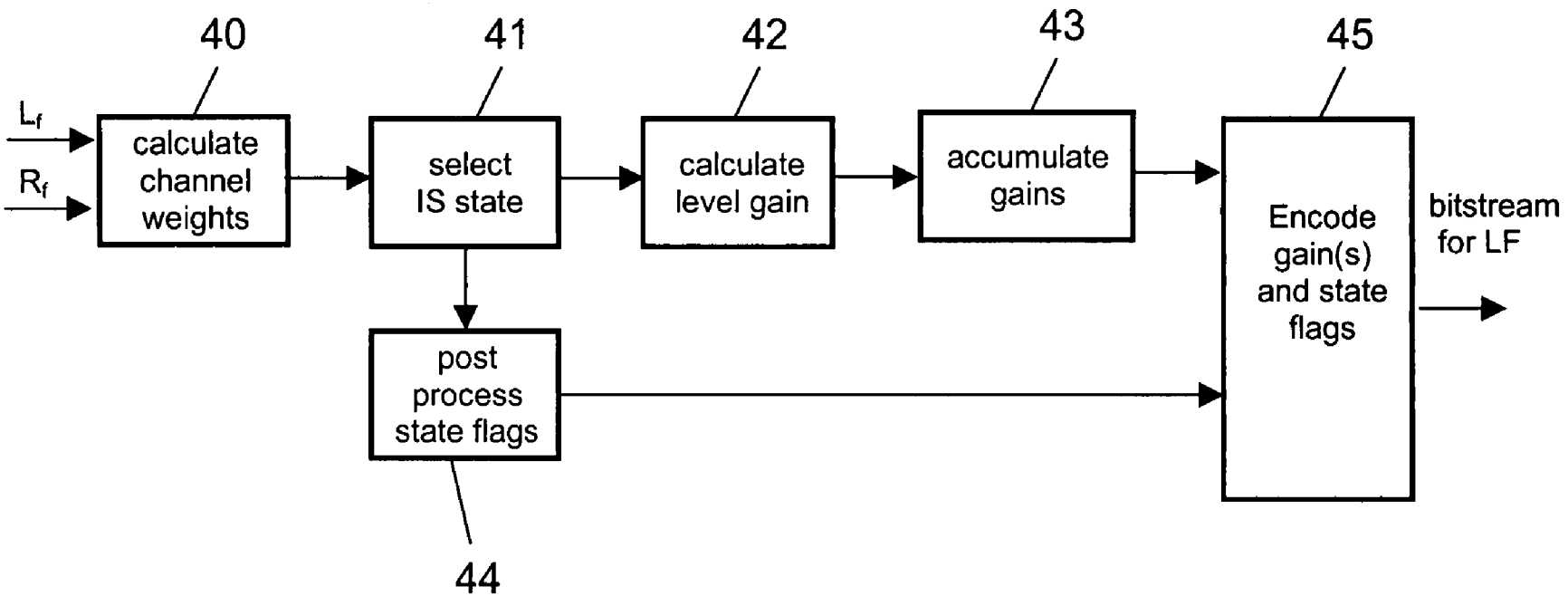
FIG. 4 is a high level block diagram of a middle frequency or a high frequency encoder in the superframe stereo extension encoder of FIG. 3.

The respective processing in the MF encoder 34 and the HF encoder 33 is illustrated in more detail in FIG. 4.

The MF encoder 34 and the HF encoder 33 comprise a similar arrangement of processing portions 40 to 45, which operate partly in the same manner and partly differently. First, the common operations in processing portions 40 to 44 will be described.

The spectral channel signals $L_f$ and $R_f$ for the respective region are first processed within the current frame in several adjacent frequency bands. The frequency bands follow the boundaries of critical bands, as explained in detail by E. Zwicker, H. Fastl in "Psychoacoustics, Facts and Models", Springer-Verlag, 1990.

For example, for coding of mid frequencies from 800 Hz to 6.05 kHz at a sample rate of 32 kHz, the widths CbStWidthBuf_mid[ ] in samples of the frequency bands for a total number of frequency bands numTotalBands of 27 are as follows:

CbStWidthBuf_mid[27]={3, 3, 3, 3, 3, 3, 3, 4, 4, 5, 5, 5, 6, 6, 7, 7, 8, 9, 9, 10, 11, 14, 14, 15, 15, 17, 18}.

For coding of high frequencies from 6.05 kHz to 16 kHz at a sample rate of 32 kHz, the widths CbStWidthBuf_mid[ ] in samples of the frequency bands for a total number of frequency bands numTotalBands of 7 are as follows:

CbStWidthBuf_high[7]={30, 35, 40, 45, 50, 60, 138}.

A first processing portion 40 computes channel weights for each frequency band for the spectral channel signals $L_f$ and $R_f$, in order to determine the respective influence of the left and right channel signals L and R in the original stereo audio signal in each frequency band.

The two channels weights for each frequency band are computed according to the following equations:

$$\text{IS_flag}(fband) = \begin{cases} \text{LEFT}, & \text{if } A \text{ and } gL_{ratio} > \text{threshold} \\ \text{RIGHT}, & \text{if } B \text{ and } gR_{ratio} > \text{threshold} \\ \text{CENTER}, & \text{otherwise} \end{cases} \tag{3}$$

with $$A = g_L(f\text{band}) > g_R(f\text{band})$$

$$B = g_R(f\text{band}) > g_L(f\text{band})$$

$$gL_{ratio} = g_L(f\text{band}) / g_R(f\text{band})$$

$$gR_{ratio} = g_R(f\text{band}) / g_L(f\text{band})$$

The parameter threshold in Equation (2) determines how good the reconstruction of the stereo image should be. In the current embodiment, the value of the parameter threshold is set to 1.5. Thus, if the weight of one of the spectral channels does not exceed the weight of the respective other one of the spectral channels by at least 50%, the state flag represents the CENTER state.

In case the state flag represents a LEFT state or a RIGHT state, in addition level modification gains are calculated in a subsequent processing portion 42. The level modification gains allow a reconstruction of the stereo audio signal within the frequency bands when proceeding from the mono audio signal M.

The level modification gain $g_{LR}$(fband) is calculated for each frequency band fband according to the equation:

$$g_{LR}(fband) = \begin{cases} 0.0, & \text{if IS_flag}(fband) = \text{CENTER} \\ gL_{ratio} & \text{if IS_flag}(fband) = \text{LEFT} \\ gR_{ratio}, & \text{otherwise} \end{cases} \tag{4}$$

$$\begin{cases} g_L(fband) = \sqrt{\dfrac{E_L}{E_L + E_R}} \\ g_R(fband) = \sqrt{\dfrac{E_R}{E_L + E_R}} \end{cases} \tag{2}$$

-continued $$fband = 0, \ldots, numTotalBands - 1$$

with $$E_L = \sum_{i=0}^{CbStWidthBuf[fband]-1} L_f(n+i)^2$$

$$E_R = \sum_{i=0}^{CbStWidthBuf[fband]-1} R_f(n+i)^2,$$

where fband is a number associated to the respectively considered frequency band, where n is the offset in spectral samples to the start of this frequency band fband, and where CbStWidthBuf is CbStWidthBuf_high or CbStWidthBuf_mid, depending on the respective frequency region. That is, the intermediate values $E_L$ and $E_R$ represent the sum of the squared level of each spectral sample in a respective frequency band and a respective spectral channel signal.

In a subsequent processing portion 41, to each frequency band one of the states LEFT, RIGHT and CENTER is assigned. The LEFT state indicates a dominance of the left channel signal in the respective frequency band, the RIGHT state indicates a dominance of the right channel signal in the respective frequency band, and the CENTER state represents mono audio signals in the respective frequency band. The assigned states are represented by a respective state flag IS_flag(fband) which is generated for each frequency band.

The state flags are generated more specifically based on the following equation:

The generated level modification gains $g_{LR}$(fband) and the generated stage flags IS_flag(fband) are further processed on a frame basis for transmission.

The level modification gains are used for determining a common gain value for all frequency bands, which is transmitted once per frame. The common level modification gain $g_{LR_average}$ is calculated in processing portion 43 for each frame according to the equation:

$$g_{LR_average} = \sqrt{\frac{1}{N} \cdot \sum_{i=0}^{numTotalBands-1} g_{LR}(i)} \tag{5}$$

with $$N = \sum_{i=0}^{numTotalBands-1} \begin{cases} 1, & \text{if IS_flag}(i) \neq \text{CENTER} \\ 0 & \text{otherwise} \end{cases}$$

Thus, the common level modification gain $g_{LR_average}$ constitutes the average of all frequency band associated level modification gains $g_{LR}$(fband) which are not equal to zero.

Such an average gain, however, represents only the spatial strength within the frame. If large spatial differences are present between the frequency bands, at least the most significant bands are advantageously considered in addition separately. To this end, for those frequency bands which have a very high or a very low gain compared to the common level modification gain, an additional gain value can be transmitted which represents a ratio indicating by how much the gain of a frequency band is higher or lower than the common level modification gain.

In addition, processing portion 44 applies a post-processing to the state flags, since the assignment of the spectral bands to LEFT, RIGHT and CENTER states is not perfect.

As mentioned above, the state flags IS_flag(fband) are determined separately for each frame in the subframe.

Now, based on the state flags IS_flag(fband), an N×S matrix stFlags is defined which contains the state flags for the spectral bands covering the targeted spectral frequencies for all frames of a superframe. N represents the number of frames in the current subframe and S the number of frequency bands in the respective frequency region. For the MF region, the size of the matrix is thus 4×27 and for the HF region, the size of the matrix is 4×7.

A post-processing is then performed by processing portion 44 according to the following pseudo code:

```
if(stFlags[0][j]==stFlags[1][j])
if(stFlags[−1][j]==stFlags[2][j])
if(stFlags[1][j]!=stFlags[2][j])
stFlags[0][j]=stFlags[−1][j]
stFlags[1][j]=stFlags[−1][j]
if(stFlags[1][j]==stFlags[2][j])
if(stFlags[0][j]==stFlags[3][j])
if(stFlags[1][j]!=stFlags[0][j])
stFlags[1][j]=stFlags[0][j]
stFlags[2][j]=stFlags[0][j]                    (6)
```

where stFlags[−1][j] corresponds to stFlags[3][j] of the previous superframe. Equation (6) is repeated for all frequency bands j, that is for $0 \leqq j < S$.

While the processing described so far is the same in the HF encoder 33 and the MF encoder 34, the following processing is somewhat different in both portions and will thus be described separately.

When the state flags have been post-processed in processing portion 44, a bitstream is formed by the encoding portion 45 of the MF encoder 34 for transmission. To this end, for each spectral band, a two-bit value is first provided to indicate whether the state flags for a frequency band are the same for all four frames of the superframe. A value of '11' is used to indicate that the state flags for a specific frequency band are not all the same. In this case, the distribution of the state flags for the respective frequency band is coded by a bitstream as defined in the following pseudo code:

```
/*-- Stereo flags not same. --*/
Send a '11' value
prevFlag = stFlags[−1][j];
for(i = 0; i < N; i++)
{
    uint8 isState = stFlags[i][j];
    if(isState == prevFlag)
        Send a '1' bit
    else
    {
        Send a '0' bit
  if(prevFlag == CENTER)
  {
    if(isState == LEFT)
        Send a '0' bit
    else
        Send a '1' bit
  }
  if(prevFlag == LEFT)
```

-continued

```
        {
          if(isState == CENTER)
            Send a '0' bit
          else
            Send a '1' bit
        }
        if(prevFlag == RIGHT)
        {
          if(isState == CENTER)
            Send a '0' bit
          else
            Send a '1' bit
        }
      }
      prevFlag = isState;
    }
```

Here, is State represents the state flag of the currently considered frame and prevFlag the state flag of the preceding frame for a particular frequency band. Moreover, i refers to the $i^{th}$ frame in the superframe and j to the jth middle frequency band.

Thus, for after a two-bit indication '11' that the state flag for a specific frequency band j is not the same for all frames i of the superframe, a '1' is used for indicating that the state flag for a frame i is equal to the state flag for a preceding frame i, while a '0' is used for indicating that the state flag for a frame i is not equal to the state flag for a preceding frame i. In the latter case, a further bit indicates specifically which other state is represented by the state flag for the current frame i.

A corresponding bitstream is provided by the encoding portion 45 for each frequency band j to the stereo extension multiplexer 36.

Moreover, the encoding portion 45 of the MF encoder 34 quantizes the common level modification gain $g_{LR_average}$ for each frame and possible additional gain values for significant frequency bands in each frame using scalar or, preferably, vector quantization techniques. The quantized gain values are coded into a bit sequence and provided as additional side information bitstream to the stereo extension multiplexer 36 of FIG. 3. The high-level bitstream syntax for the coded gain for one frame is defined by the following pseudo-code:

```
mid_band_present                1-bit
if(mid_band_present == '1')
{
  midGain                       5-bits
  Band specific gains
}
```

Here, midGain represents the average gain for the middle frequency bands of a respective frame. The encoding is performed such that no more than 60 bits are used for the band specific gain values. A corresponding bitstream is provided by the encoding portion 45 for each frame i in the superframe to the stereo extension multiplexer 36.

The encoding portion 45 of the HF encoder 33, in contrast, checks first whether the encoding scheme used by the encoding portion 45 of the MF encoder 34, should be used as well for the high frequencies. The described coding scheme will be employed only if it requires less bits than a second encoding scheme.

According to the second encoding scheme, for each frame first one bit is transmitted to indicate whether the state flags of the previous frame should be used again. If this bit has a value of '1', the state flags of the previous frame shall be used for the current frame. Otherwise, an additional two bits will be used for each frequency band for representing the respective state flag.

Moreover, the encoding portion 45 of the HF encoder 33 quantizes the common level modification gain $g_{LR_average}$ for each frame and possible additional gain values for significant frequency bands in each frame using scalar or, preferably, vector quantization techniques.

The following pseudo-code defines the high-level bitstream syntax for the second coding scheme for the high frequency bands of a respective frame:

```
high_band_present                1-bit
if(high_band_present == '1')
{
  if(decodeStInfo)
  {
    flags_present                1-bit
    if(flags_present == '1')
      Use flags from previous frame
    Else
      for (j = 0; j < 7; j++)
        stFlags_high[i][j]       2-bits
  }
  gain_present                   1-bit
  if(gain_present == '1')
   highGain                      5-bits
  Else
   Use gain value of previous frame
  Band specific gains
}
```

Here, decodeStInfo indicates whether the state flags should be decoded for a frame or whether the state flags of the previous frame should be used. Moreover, i refers to the $i^{th}$ frame in the superframe and j to the $j^{th}$ high frequency band highGain represents the average gain for the high frequency bands of a respective frame. The encoding is done such that no more than 15 bits are used for the band specific gain values. This limits the number of frequency bands for which a band specific gain value is transmitted to two or three bands at a maximum. The pseudo-code is repeated for each frame in the superframe.

A two-bit indication of the employed coding scheme and the coded state flags for all frequency bands are provided together with the coded gain values for each frame to the stereo extension multiplexer 36 of FIG. 3.

While the coding described above with reference to FIG. 3 is suitable for high and middle frequencies, respectively, the frequency response would not match the requirements on a good stereo quality at low frequencies. At low frequencies, only a coarse representation of the stereo image could be achieved with the described type of coding. In addition, when a high time resolution is used, namely by using short frame lengths, the stereo image would tend to move more than what is typically allowed for an acceptable quality.

Figure 5:
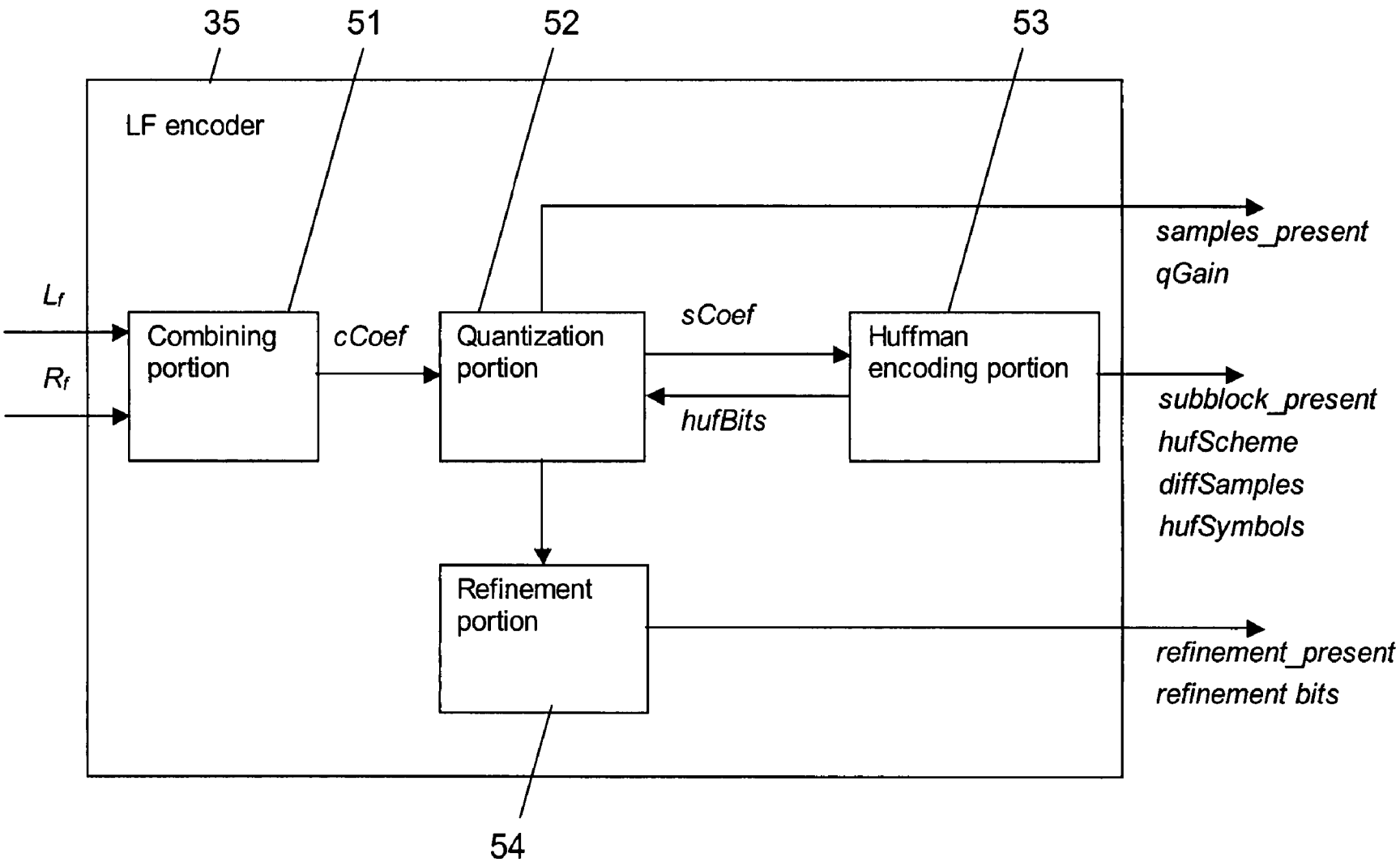
FIG. 5 is a high level block diagram of a low frequency encoder in the superframe stereo extension encoder of FIG. 3.

The processing in the LF encoder 35 is illustrated in more detail in the schematic block diagram of FIG. 5.

The LF encoder 35 comprises a combining portion 51, a quantization portion 52 a Huffman coding portion 53 and a refinement portion 54. The combining portion 51 receives left and right channel matrices $L_f$, $R_f$ for each superframe, each having a size of N×M, for example 4×32. The matrices LF and $R_f$ comprise the frequency domain signals of the left and the right channel, respectively, of an audio signal. The N columns comprise samples for N different frames of a superframe, while the M rows comprise samples for M different frequency bands of the low frequency region. The combining portion 51 forms a single matrix cCoef having a size of N×M out of these left and right channel matrices $L_f$, $R_f$ by determining the difference between the signals for each sample:

$$cCoef[i][j] = \frac{L_f[i][j] - R_f[i][j]}{2}, \quad \begin{matrix} 0 \le i < 4 \\ 0 \le j < 32 \end{matrix} \tag{7}$$

The samples in the resulting matrix cCoef are the spectral samples which are to be encoded by the LF encoder 35. As will be explained in more detail with reference to FIGS. 6 and 7, the quantization portion 52 quantizes the received samples to integer values, the Huffman coding portion 53 encodes the quantized samples and the refinement portion 54 produces additional information in case there are remaining bits available for the transmission.

Figure 6:
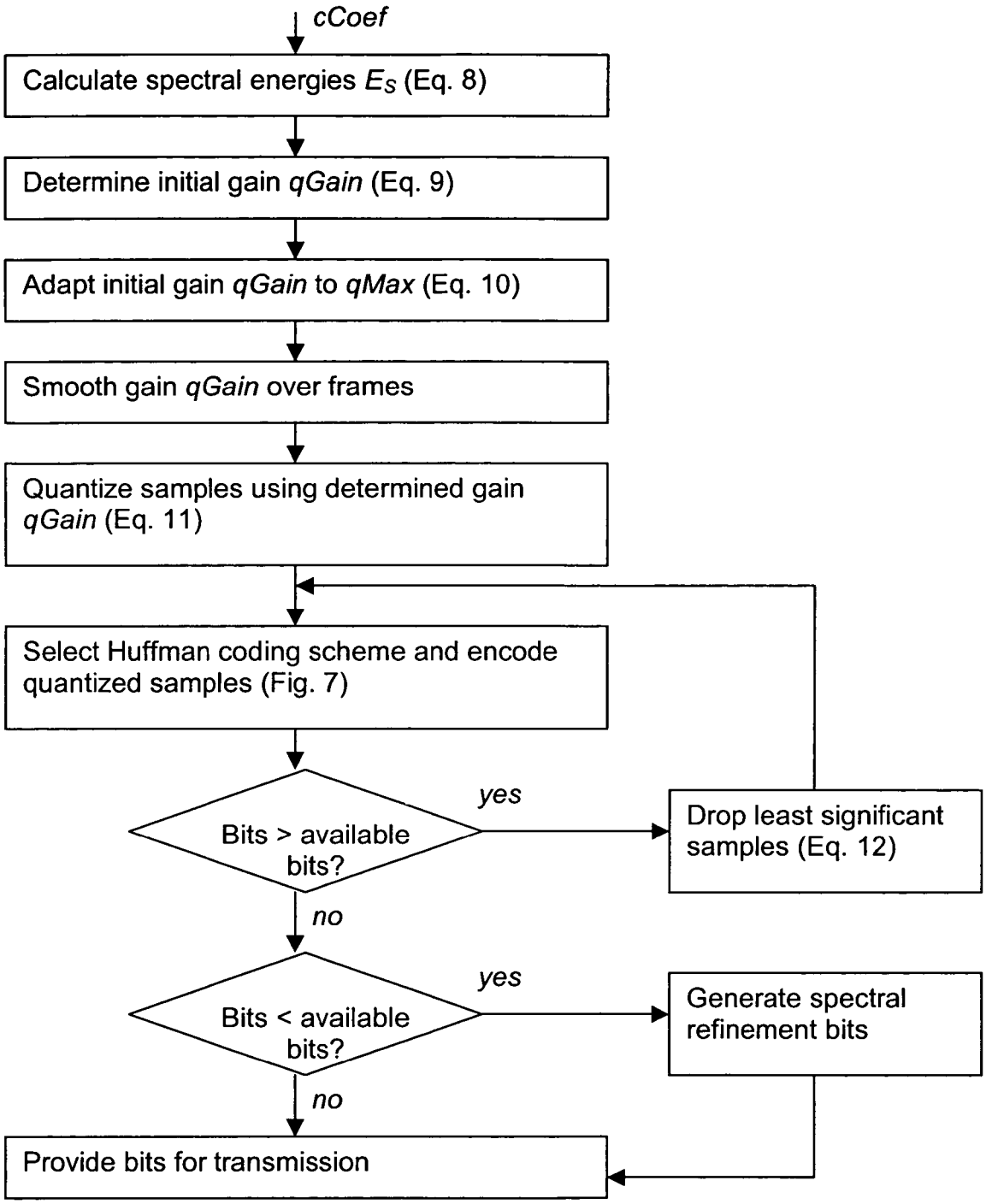
FIG. 6 is a flow chart illustrating a quantization in the low frequency encoder of FIG. 5.

FIG. 6 is a flow chart illustrating the quantization by the quantization portion 52 and its relation to the Huffman encoding and the generation of refinement information.

For each superframe formed by the grouping portion 32, a matrix cCoef is generated and provided to the quantization portion 52 for quantization.

The quantization portion 52 calculates first the spectral energy $E_s$[i] [j] of each sample in the matrix cCoef, and sorts the resulting energy array $E_s$ according to the following equations:

$$E_s[i][j] = cCoef[i][j] \cdot cCoef[i][j], \quad \begin{matrix} 0 \le i < N \\ 0 \le j < M \end{matrix} \tag{8}$$

$$SORT(E_s)$$

SORT( ) represents a sorting function which sorts the energy array $E_s$ in a decreasing order of energies. A helper variable is also used in the sorting operation to make sure that the encoder knows to which spectral location the first energy in the sorted array corresponds, to which spectral location the second energy in the sorted array corresponds, and so on. This helper variable is not explicitly shown in Equations (8).

Next, the quantization portion 52 determines the quantization gain which is to be employed in the quantization. An initial quantizer gain is calculated according to the following equation:

$$qGain = \left\lfloor \frac{1}{\log_{10}(2) \cdot 0.25} \cdot \log_{10}\left(\frac{\max(cCoef)}{A+2}\right) + 0.5 \right\rfloor \tag{9}$$

where max(cCoef) returns the maximum absolute value of all samples in the matrix cCoef and where A describes the maximum allowed amplitude level for the samples. A can be assigned for example a value of 10.

Then, the quantization portion 52 adapts the initial gain to a targeted amplitude level qMax. To this end, the initial gain qGain is incremented by one, if $$\lfloor \max(cCoef) \cdot 2^{-0.25 \cdot qGain} + 0.2554 \rfloor < qMax. \tag{10}$$

The above function $\lfloor(x)\rfloor$ provides the next lower integer of the operand x. qMax can be assigned for example a value of 5.

To avoid sudden changes in the quantizer gain from frame to frame, the quantization portion 52 moreover performs a smoothing of the gain. To this end, the quantization gain qGain determined for the current frame is compared with the quantization gain qGainPrev used for the preceding frame and adjusted such that large changes in the quantization gain are avoided. This can be achieved for instance in accordance with the following pseudo code:

```
dGain = qGain − qGainIdx;
if(!(dGain<qGainPrev && qGainPrev>minGain && qGainIdx))
  qGain −= qGainIdx;
if(qGainIdx == 0)
{
  gainDiff = |qGain − qGainPrev|;
  if(gainDiff > 5)
  { (16)
  if(qGain > qGainPrev)
  {
    if(prevGain ≦ minGain)
    {
      gainDiff = sqrt(qGain);
      qGain −= gainDiff;
      qGainIdx = gainDiff − 1:
    }
    else
      qGainIdx = gainDiff − 1;
  }
}
}
qGainIdx −= 1;
if(qGainIdx < 0)
  qGainIdx = 0;
```

Here, qGainPrev is the transmitted quantization gain of the previous frame and qGainIdx describes the smoothing index for the gain on a frame-by-frame basis. The variable qGainIdx is initialized to zero at the start of the encoding process. The minimum gain minGain can be set for example to 22.

The quantization portion 52 provides to the stereo extension multiplexer 36 for each frame one bit samples_present for indicating whether samples are present in the current frame and six bits indicating the final quantization gain qgain minus the minimum gain minGain.

Using the resulting gain qGain, the spectral samples in the matrix cCoef are quantized below the targeted amplitude level qMax according to the following equation:

$$qCoef[i][j] = \text{sign}(cCoef[i][j]) \cdot \lfloor |cCoef[i][j]| \cdot 2^{-0.25 \cdot qGain} + 0.2554 \rfloor \tag{11}$$

$$\text{sign}(x) = \begin{cases} -1, & \text{if } x \le 0 \\ 1, & \text{otherwise} \end{cases}$$

The above equation is applied to all samples in the matrix cCoef, that is, to all samples with 0≦i<N and 0≦j<M, resulting in a quantized matrix qCoef having equally a size of N×M.

The quantized matrix qCoef is now provided to the Huffman encoding portion 53 for encoding. This encoding will be explained in more detail further below with reference to FIG. 7.

The encoding by the Huffman encoding portion 53 may result in more bits that are available for the transmission. Therefore, the Huffman encoding portion 53 provides a feedback about the number of required bits to the quantization portion 52.

In case the number of bits is larger that the number of allowed bits, that is, 540 bits minus the bits required for the HF region and the MF region, the quantization portion 52 has to modify the quantized spectra in a way that it results in less bits in the encoding.

To this end, the quantization portion 52 modifies the quantized spectra more specifically such that the least significant spectral sample in the quantized matrix qCoef is set to zero in accordance with the following equation:

$$qCoef[leastIdx_i][leastIdx_j]=0 \quad (12)$$

where leastIdx_I and leastIdx_j describe the row and the column, respectively, of the spectral sample that has the smallest energy according to the sorted energy array $E_s$. Once the sample has been set to zero, the spectral bin is removed from the sorted energy array $E_s$ so that next time Equation (12) is called, the smallest spectral sample among the remaining samples can be removed.

Now, encoding the samples based on the new quantized matrix qCoef by the Huffman encoding portion 53 and modifying the quantized spectra by the quantization portion 52 is repeated in a loop, until the number of resulting bits does not exceed the number of allowed bits anymore. The encoded spectra and any related information are provided by the quantization portion 52 and the Huffman encoding portion 53 to the stereo extension multiplexer 36 for transmission.

After the final quantization and encoding, it is possible that the number of used bits is significantly lower than the number of available bits. In this case, it is of advantage to transmit additional information about the quantized spectra instead of pure padding bits for achieving exactly the target bitrate. Such additional information may refine the quantization accuracy of the transmitted spectral samples. If the encoding part requires a total of n bits and there are m bits available, then the number of bits which are available after encoding the quantized spectral samples is bits_available=m−n. If the number of available bits is larger than some threshold value, a bit refinement_present having a value of '1' is provided for transmission to indicate that refinement bits are transmitted as well. If the number of available bits is smaller than the threshold value, a bit having a value of '1' is provided for transmission to indicate that no refinement bits are present in the bitstream.

An example of refinement information which may be generated will be presented in the following.

In the final quantized spectra qCoef, a maximum amplitude value of B was allowed. The accuracy of this spectrum can now be improved by defining another quantized spectra qCoef2, in which the maximum allowed amplitude value is C, which is larger than B. If B is set to 5, C may be set for example to 9. The difference between the underlying quantization gain and the difference between the matrices qCoef and qCoef2 can then be used as refinement information.

Corresponding refinement bits can determined for example in accordance with the following pseudo code:

```
if(bits_available > (gainBits + ampBits))
{
  qGain2                                  gainBits -bits
  qGain2 = −qGain2 + qGain;
  bits_available −= gainBits;
  for(j = 0; j < M; j++)
   for(i = 0; i < N; i++)
   {
    if(qCoef[i][j] != 0)
    {
      if(bits_available > ampBits)
      {
        bits_available −= ampBits;
        bsCoef                                ampBits-bits
        if(qCoef[i][j] > 0)
          qCoef[i][j] += bsCoef;
        Else
          qCoef[i][j] −= bsCoef;
        Dequantize 'qCoef [i][j]' with qGain2
      }
    }
  if(bits_available > 3)
  {
    for(j = 0; j < M; j++)
     for(i = 0; i < N; i++)
     {
      if(qCoef[i][j] == 0)
      {
        if(bits_available > 3)
        {
        bits_available −= 2;
        bsCoef                        2-bits
        if(bsCoef == '00' or bsCoef == '01')
          qCoef[i][j] = bsCoef;
        else if(bsCoef == '11')
          qCoef[i][j] = −1;
        Else
        {
          bits_available −= 1;
          bsCoefSign            1-bit
          qCoef[i][j] = bsCoef;
          if(bsCoefSign == '1')
            qCoef[i][j]= − qCoef[i][j];
        }
        Dequantize 'qCoef[i][j]' with qGain2
      }
    }
  }
}
```

The gainBits can be set for example to 4 and the ampBits can be set for example to 2. As can be seen from the above pseudo code, the difference between qCoef2 and qCoef is provided on a time-frequency dimension. Also the quantizer gain is provided as a difference. If the differences for all non-zero spectral samples have been provided and there are still bits available, the refinement module may start to send bits for spectral samples that were transmitted as zero in the original spectra.

Figure 7:
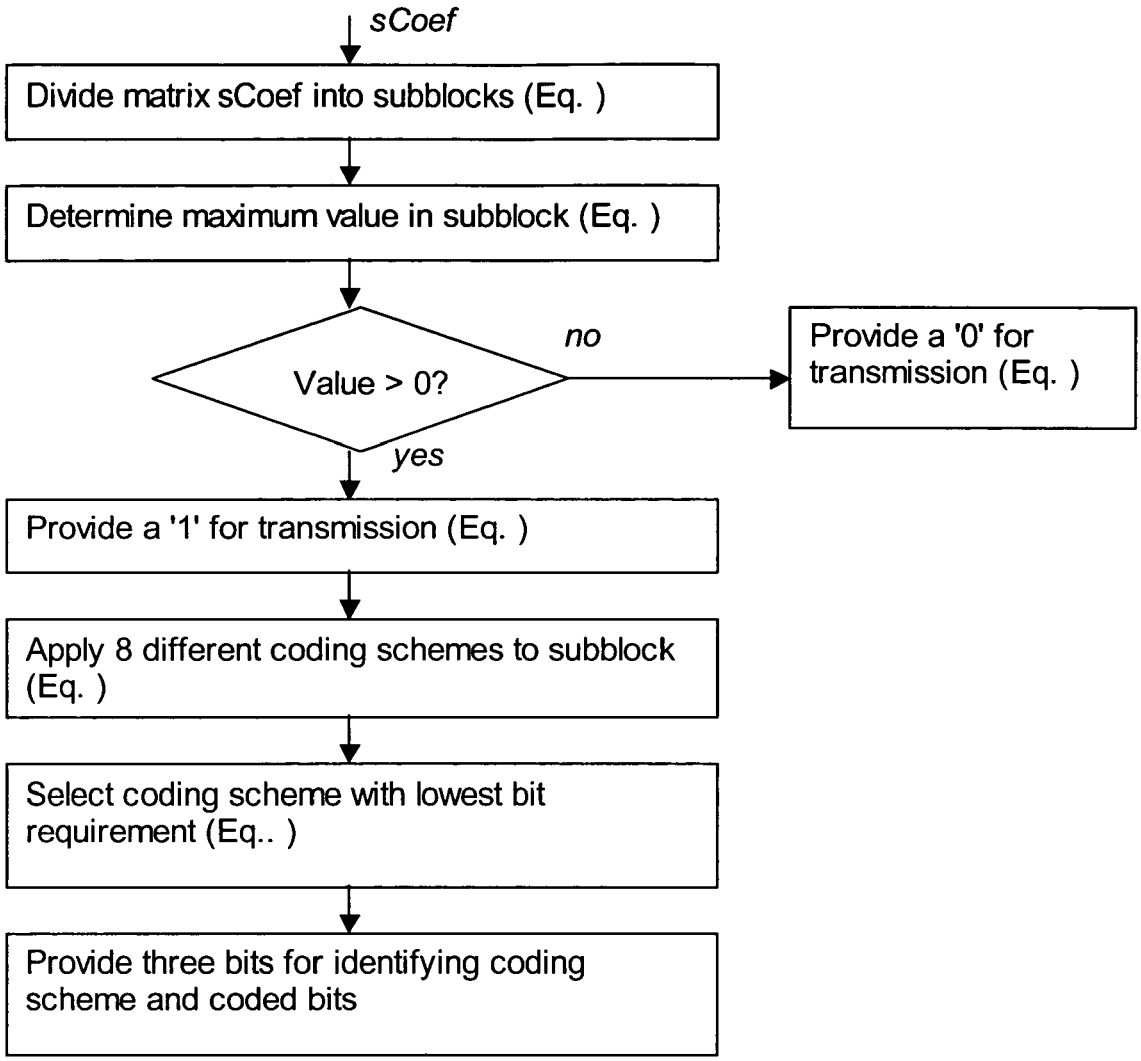
FIG. 7 is a flow chart illustrating a Huffman encoding in the low frequency encoder of FIG. 5.

As mentioned above, the processing in the Huffman encoding portion 53 is illustrated by the flow chart of FIG. 7.

The Huffman encoding portion 53 receives from the quantization portion 52 the matrix sCoef having the size N×M.

For encoding, the matrix sCoef is first divided into frequency subblocks. The boundaries of each subblock are set approximately to the critical band boundaries of human hearing. The number of blocks can be set for example to 7. The subblock sizes can be represented by a table cbBandWidths [8], in which each table index contains a pointer to the respective first frequency band of the subblocks as follows:

$$cbBandWidths[8]=\{0, 4, 8, 12, 16, 20, 25, 32\}; \quad (13)$$

The size of an $n^{th}$ subblock can then be calculated in accordance with the following equation:

$$subblock_width_nth=cbBandWidth[n+1]-cbBandWidth[n] \quad (14)$$

Next, for each of the subblocks the following operations are performed. First, the samples belonging to the nth subblock are gathered in a matrix x in accordance with the following equation:

$$x[i][j] = sCoef[i][cbBandWidths[n] + j] \quad (15)$$

$$\text{with} \quad \begin{array}{l} 0 \le i < N \\ 0 \le j < \text{subblock_width_nth} \end{array}$$

In this equation, the parameter subblock_width_nth is calculated according to Equation (14).

Next, the maximum value present in matrix x is located. If this value is equal to zero, a '0' bit is transmitted for the subblock for indicating that the value of all samples within the subblock are equal to zero. Otherwise a '1' bit is transmitted to indicate that the subblock contains non-zero spectral samples. In this case a Huffman coding scheme is selected for the subblock spectral samples. There are eight Huffman coding schemes available and, advantageously, the scheme which results in a minimum bit usage is selected for encoding.

Therefore, the samples of a respective subblock are first encoded with each of the eight Huffman coding schemes, and the scheme resulting in the lowest bit number is selected.

Each Huffman coding scheme operates on a pairwise sample basis. That is, first, two successive spectral samples are grouped and a Huffman index is determined for this group. The Huffman index is determined according to the following equation:

$$hCbIdx = |y| \cdot (x\text{Amp}+1) + |z|, \quad (16)$$

where y and z are the amplitude values of 2 successive grouped spectral samples, and where xAmp is the maximum absolute value allowed for the quantized samples. After the Huffman index has been calculated for the 2-tuple samples, a Huffman symbol is selected which is associated according to a specific Huffman coding scheme to this Huffman index. In addition, a sign has to be provided for each non-zero spectral sample, as the calculation of the Huffman index does not take account of the sign of the original samples.

Next, the eight Huffman coding schemes are explained in more detail.

For a first Huffman coding scheme, the spectral samples in a matrix x of a respective subblock are used to fill a sample buffer according to the following equation:

$$sampleBuffer[sbOffset] = x[i][j], \quad \begin{array}{l} 0 \le i < N \\ 0 \le j < \text{subblock_width} \\ sbOffset = i \cdot M + j \end{array} \quad (17)$$

Then, the Huffman index is calculated with Equation (16) for each pair of two successive samples in this buffer. The Huffman symbol corresponding to this index is retrieved from a table hIndexTable which is associated in FIG. 8 to a Huffman scheme 1. In this table, the first column contains the number of bits of a Huffman symbol reserved for an index and the second column contains the corresponding Huffman symbol that will be provided for transmission. In addition the signs of both samples are determined.

The encoding based on the first Huffman coding scheme can be carried out in accordance with the following pseudo-code:

```
/**-- Encode samples via 2-dimensional Huffman table. --*/
for(i = 0; i < sbOffset; i+=2)
{
/*-- Get Huffman index for sampleBuffer[i] and
sampleBuffer[i+1]. --*/
hCbIdx = Equation(16);
/*-- Count bits and write Huffman symbol to bitstream. --
*/
hufBits += hIndexTable[hCbIdx][0];
hufSymbol = hIndexTable[hCbIdx][1];
  Send 'hufSymbol' of 'hIndexTable[hCbIdx][0]' bits
  /*-- Write sign bits. --*/
  if(sampleBuffer[i])
  {
    if(sampleBuffer[i] < 0)
      Send a '0' bit
    Else
      Send a '1' bit
  }
  if (sampleBuffer[i+1])
  {
    if(sampleBuffer[i+1] < 0)
      Send a '0' bit
    Else
      Send a '1' bit
  }
}
```

In this pseudo-code, hufBits is used for counting the bits required for the coding and hufSymbol indicates the respective Huffman symbol.

The second Huffman coding scheme is similar to the first scheme. In the first scheme, however, the spectral samples are arranged for encoding in a frequency-time dimension, whereas in the second scheme, the samples are arranged for encoding in a time-frequency dimension. To this end, the spectral samples in a matrix x of a respective subblock are used to fill a sample buffer according to the following equation:

$$sampleBuffer[sbOffset] = x[i][j], \quad \begin{array}{l} 0 \le j < \text{subblock_width} \\ 0 \le i < N \\ sbOffset = j \cdot N + i \end{array} \quad (18)$$

The samples in the sampleBuffer are then encoded as described for the first Huffman coding scheme but using the table hIndexTable which is associated in FIG. 8 to a Huffman scheme 2 for retrieving the Huffman symbols.

For the third Huffman coding scheme, the buffer is filled again in accordance with Equation (16). The third Huffman coding scheme, however, assigns in addition a flag bit to each frequency line, that is to each frequency band, for indicating whether non-zero spectral samples are present for a respective frequency band. A '0' bit is transmitted if all samples of a frequency band are equal to zero and a '1' bit is transmitted for those frequency bands in which non-zero spectral samples are present. If a '0' is transmitted for a frequency band, no additional Huffman symbols are transmitted for the samples from the respective frequency band. The encoding is based on the Huffman scheme 3 depicted in FIG. 8 and can be achieved in accordance with the following pseudo-code:

```
/*-- Encode samples via 2-dimensional Huffman table. --*/
for(row=0; row < N; row++)
{
int16 *fLineSpec = sampleBuffer + row * subblock_width;
for(column = 0, allZero = TRUE; column < subblock_width;
column++)
   if(fLineSpec[column])
   {
      allZero = FALSE;
      break;
   }
hufBits +=1;
if(!allZero)
{
         BOOL useExt;
     int16 hCbIdx, lines;
     /*-- Freqency line within subblock significant. --*/
     Send a '1' bit
     useExt = subblock_width & 0x1;
     lines = subblock_width – useExt;
     /*-- Count and code non-zero spectral line. --*/
     for(column = 0; column < lines; column+=2)
     {
         /*-- Get Huffman index for fLineSpec[column] and
fLineSpec[column+1]. --*/
         hCbIdx = Equation(16);
         /*-- Count bits and write Huffman symbol to
bitstream. --*/
         hufBits += hIndexTable[hCbIdx][0];
         hufSymbol = hIndexTable[hCbIdx][1];
         Send 'hufSymbol' of 'hIndexTable[hCbIdx][0]' bits
   /*-- Write sign bits. --*/
   if(fLineSpec[column])
   {
      if(fLineSpec[column] < 0)
         Send a '0' bit
      else
         Send a '1' bit
   }
   if(fLineSpec[column+1])
   {
      if(fLineSpec[column+1] < 0)
         Send a '0' bit
      else
         Send a '1' bit
   }
    }
    /*-- Use symmetric extension for the last
coefficient. --*/
     if(useExt)
     {
         /*-- Get Huffman index for fLineSpec[column] and
fLineSpec[column]. --*/
         hCbIdx = Equation(16);
         /*-- Count bits and write Huffman symbol to
bitstream. --*/
         hufBits += hIndexTable[hCbIdx] [0];
         hufSymbol = hIndexTable[hCbIdx] [1];
         Send 'hufSymbol' of 'hIndexTable[hCbIdx] [0]' bits
   /*-- Write sign bits. --*/
   if(fLineSpec[column])
   {
      if(fLineSpec[column] < 0)
         Send a '0' bit
      else
         Send a '1' bit
    }
      }
   }
   else
      /*-- Freqency line within subblock insignificant. --
   */
         Send a '0' bit
   }
```

In this pseudo-code, hufBits is used again for counting the bits required for the coding and hufSymbol indicates again the respective Huffman symbol. As can be seen from the above pseudo code, if the width of the subblock is not a multiple of 2, a symmetric extension will be used for the last coefficient to obtain the Huffman index.

The fourth Huffman coding scheme is similar to the third Huffman coding scheme. For the fourth scheme, however, a flag bit is assigned to each time line, that is to each frame, instead of to each frequency band. The spectral samples are buffered as for the second Huffman coding scheme according to Equation (18). The samples in the sample buffer sampleBuffer are then coded as described for the third coding scheme based on the table hIndexTable for the Huffman scheme 4 depicted in FIG. 9.

The fifth to eight Huffman coding schemes operate in a similar manner as the first to fourth Huffman coding schemes. The main difference is the gathering of the spectral samples which form the basis for the Huffman schemes. Huffman schemes five to eight determine for each sample of a subblock the difference between this sample in the current superframe and a corresponding sample in the previous superframe to obtain the samples which are to be coded.

The fifth Huffman coding scheme fills the sample buffer based on the following equation:

$$\begin{aligned} &sampleBuffer[sbOffset] = x[i][j] - x_{prevFrame}[i][j], \\ &\quad 0 \le i < N \\ &\text{with } 0 \le j < \text{subblock_width} \\ &\quad sbOffset = i \cdot M + j \end{aligned} \tag{19}$$

where $x_{prevFrame}$ contains the quantized samples transmitted for the previous superframe. The samples are then coded as described for the first Huffman coding scheme, but based on the table hIndexTable for the Huffman scheme 5 depicted in FIG. 9.

The sixth Huffman coding scheme fills the sample buffer based on the following equation:

$$\begin{aligned} &sampleBuffer[sbOffset] = x[i][j] - x_{prevFrame}[i][j], \\ &\quad 0 \le j < \text{subblock_width} \\ &\text{with } 0 \le i < N \\ &\quad sbOffset = j \cdot N + i \end{aligned} \tag{20}$$

The samples are then coded as described for the first scheme, but based on the table hIndexTable for the Huffman scheme 6 depicted in FIG. 10.

The seventh Huffman coding scheme arranges the samples again according to Equation (19), but codes the samples as described for the third scheme, based on the table hIndexTable for the Huffman scheme 7 depicted in FIG. 10.

Finally, the eight Huffman coding scheme arranges the samples again according to Equation (20), but codes the samples as described for the third scheme, based on the table hIndexTable for the Huffman scheme 8 depicted in FIG. 11.

To obtain the best performance, the Huffman coding scheme for which the parameter hufBits indicates that it results in the minimum bit consumption is selected for transmission. Two bits hufScheme are reserved for signaling the selected scheme. For this signaling, the above presented first and fifth scheme, the above presented second and sixth scheme, the above presented third and seventh scheme as well as the above presented fourth and eighth scheme, respectively, are considered as the same scheme. In order to differentiate between the respective two schemes, one further bit diffSamples is reserved for signaling whether a difference signal with respect to the previous superframe is used or not. The high-level bitstream syntax for each subblock is then defined according to the following pseudo-code:

```
subblock_present                    1-bit
if(subblock_present == '1')
{
  hufScheme                         2-bits
  diffSamples                       1-bit
  if(hufScheme == '00' and diffSamples == '0')
    Huffman coding scheme 1
  else if(hufScheme == '01' and diffSamples == '0')
    Huffman coding scheme 2
  else if(hufScheme == '10' and diffSamples == '0')
    Huffman coding scheme 3
  else if(hufScheme == '11' and diffSamples == '0')
    Huffman coding scheme 4
  else if(hufScheme == '00' and diffSamples == '1')
    Huffman coding scheme 5
  else if(hufScheme == '01' and diffSamples == '1')
    Huffman coding scheme 6
  else if(hufScheme == '10' and diffSamples == '1')
    Hufffman coding scheme 7
  else if(hufScheme == '11' and diffSamples == '1')
    Huffman coding scheme 8
}
```

Summarized, the Huffman encoding portion 53 transmits to the stereo extension multiplexer 36 for each subblock one bit subblock_present indicating whether the subblock is present, and possibly in addition two bits hufScheme indicating the selected Huffman coding scheme, one bit diffSamples indicating whether the selected Huffman coding scheme is used as differential coding scheme, and a number of bits hufSymbols for the selected Huffman symbols.

If the number of bits resulting the selected Huffmann coding scheme is nevertheless higher than the number of available bits, the quantization portion 52 sets some samples to zero, as described above with reference to FIG. 6.

The stereo extension multiplexer 36 multiplexes the bitstreams output by the HF encoding portion 33, the MF encoding portion 34 and the LF encoding portion 35, and provides the resulting stereo extension information bitstream to the AMR-WB+ bitstream multiplexer 25.

The AMR-WB+ bitstream multiplexer 25 then multiplexes the received stereo extension information bitstream with the mono signal bitstream for transmission, as described above with reference to FIG. 2.

Figure 12:
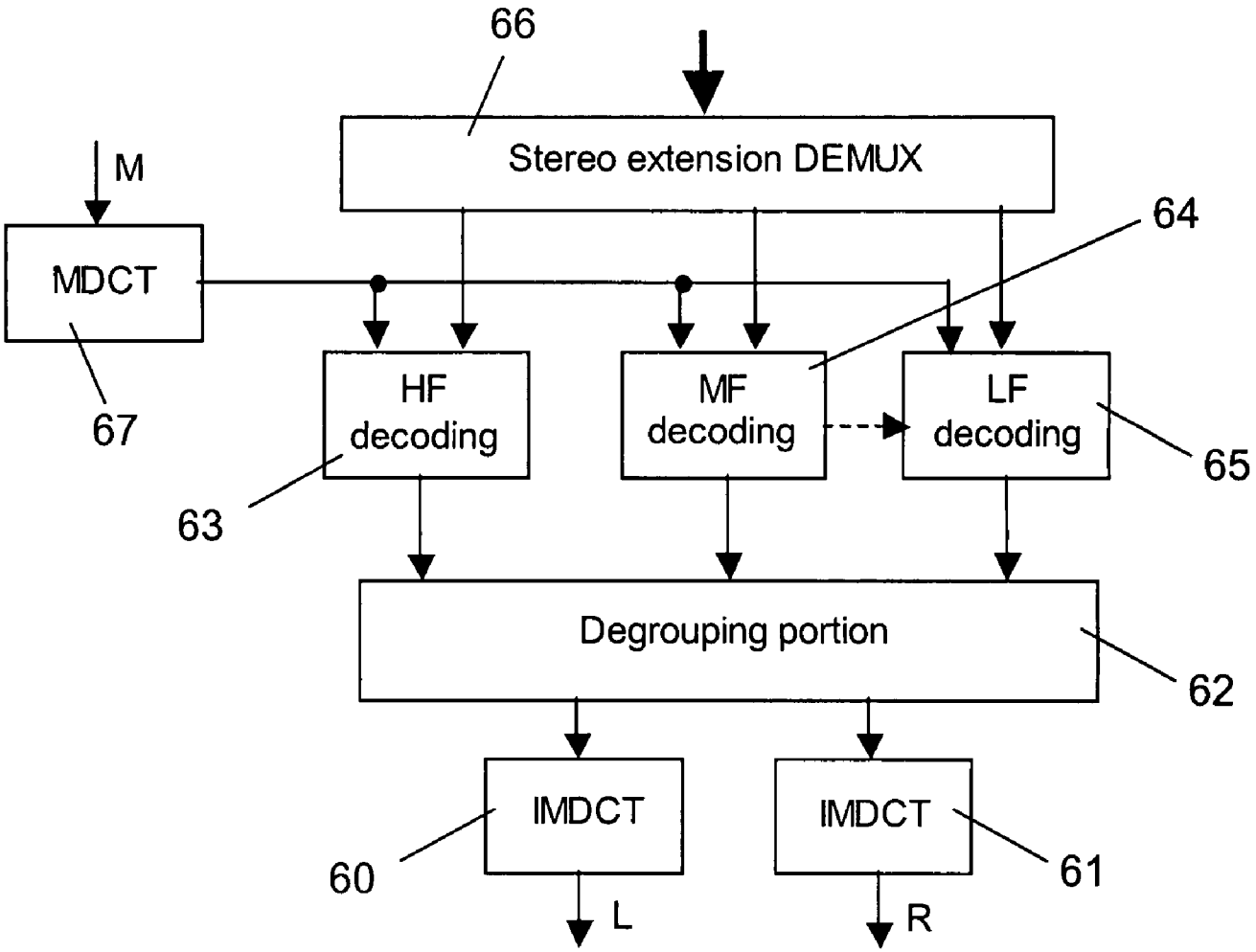
FIG. 12 is a high level block diagram of an embodiment of a superframe stereo extension decoder in accordance with the invention in the system of FIG. 2.

The structure of the superframe stereo extension decoder 29 is illustrated in more detail in FIG. 12.

The superframe stereo extension decoder 12 comprises a stereo extension demultiplexer 66, which is connected to an HF decoder 63, to an MF decoder 64 and to an LF decoder 65. The output of the decoders 63 to 64 is connected via a degrouping portion 62 to a first Inverse Modified Discrete Cosine Transform (IMDCT) portion 60 and a second IDMCT portion 61. The superframe stereo extension decoder 29 moreover comprises an MDCT portion 67, which is connected as well to each of the decoding portions.

The superframe stereo extension decoder 29 reverses the operations of the superframe stereo extension encoder 26.

An incoming bitstream is demultiplexed and the bitstream elements are passed to each decoding block 28, 29 as described with reference to FIG. 2. In the superframe stereo extension decoder 29, the stereo extension part is further demultiplexed by the stereo extension demultiplexer 66 and distributed to the decoders 63 to 65. In addition, the decoded mono M signal output by the AMR-WB+ decoder 28 is passed on to the superframe stereo extension decoder 29, transformed to the frequency domain by the MDCT portion 67 and provided as further input to each of the decoders 63 to 65. Each of the decoders 63 to 65 then reconstructs those stereo frequency bands for which it is responsible. More specifically, first, the bitstream elements of the MF range and the HF range are decoded in the MF decoder 64 and the HF decoder 63, respectively. Corresponding stereo frequencies are reconstructed from the mono signal. Next, the number of bits available for the LF coding block is determined in the same manner as it was determined at the encoder side, and the samples for the LF region are decoded and dequantized. Finally, the spectrum is combined by the degrouping portion 62 to remove the superframe grouping, and an inverse MDCT is applied by the IMDCT portions 60 and 61 to each frame to obtain the time domain stereo signals L and R.

In the MF decoder 64, two bits are first read on a spectral band basis. If the bit value '11' is read, the state information is decoded in accordance with the pseudo-code presented above for the MF encoder 34. Otherwise the two-bit value is used to assign the correct states to each time line of frequency band j in accordance with the following equations:

$$stFlags[0][j] = \begin{cases} \text{CENTER}, & \text{bit_value} == \text{'00'} \\ \text{LEFT}, & \text{bit_value} == \text{'01'} \\ \text{RIGHT}, & \text{bit_value} == \text{'10'} \end{cases} \tag{21}$$

$$stFlags[1][j] = stFlags[2][j] = stFlags[3][j] = stFlags[0][j]$$

The two-channel representation of the mono signal for the spectral frequency bands covered by the stereo flags can then be achieved in accordance with the following pseudo-code:

```
/*-- Extend mono input to stereo output. --*/
for(i = 0; i < N; i++)
  for(j = 0, offset = startBin; j < S; j++)
  {
    int16 sbLen, k, offset2;
    FLOAT gainA, gainB, bGain2, bGain0;
    sbLen = cbStWidthBuf[i];
    /*-- Smoothing parameters... */
    /*-- ... for no smoothing. --*/
    offset2 = 0;
    bGain2 = 0.0f;
    gainA = stGain[i][j];
    gainB = stGain[i][j];
    bGain0 = stGain[i][j];
    if(stFlags[i][j] != CENTER)
    {
      if(allZeros == FALSE)
      {
        /*-- ...for the start of a frequency band. --*/
        if(j == 0)
        {
          if(stFlags[i][j])
          {
            offset2 = (j < 20) ? 1 : 2;
            gainA = (FLOAT) sqrt(stGain[i][j]);
            }
          }
          else if(stFlags[i][j] && stFlags[i][j-1] == 0)
          {
            offset2 = (j < 20) ? 1 : 2;
            gainA = (FLOAT) sqrt((stGain[i][j] +
stGain[i][j-1]) * 0.5f);
          }
        }
      }
      if(stFlags[i][j] && stFlags[i-1][j] == 0)
```

-continued

```
        {
          gainA = (FLOAT) sqrt(gainA);
          bGain0 = (FLOAT) sqrt(stGain[i][j]);
        }
        if(stFlags[i][j]
        {
          gainB = 2.0f / (gainA + 1.0f);
          bGain2 = 2.0f / (bGain0 + 1.0f);
        }
        switch(stFlags[i][j])
        {
          case LEFT:
            for(k = 0; k < offset2; k++)
            {
              left[offset + k] = mono[offset + k] * gainB;
              right[offset + k] = left[offset + k] * gainA;
            }
            for( ; k < sbLen; k++)
            {
              left[offset + k] = mono[offset + k] * bGain2;
              right[offset + k] = left[offset + k] * bGain0;
            }
            break;
          case RIGHT:
            for(k = 0; k < offset2; k++)
            {
              right[offset + k] = mono[offset + k] * gainB;
              left[offset + k] = right[offset + k] * gainA;
            }
            for( ; k < sbLen; k++)
            {
              right[offset + k] = mono[offset + k] * bGain2;
              left[offset + k] = right[offset + k] * bGain0;
            }
            break;
          case CENTER:
          default:
            for(k = 0; k < sbLen; k++)
            {
              left[offset + k] = mono[offset + k];
              right[offset + k] = mono[offset + k];
            }
            break;
        }
        offset += sbLen;
      }
```

Here, mono is the spectral representation of the mono signal M, and left and right are the output channels corresponding to left and right channels, respectively. Further, startBin is the offset to the start of the stereo frequency bands, which are covered by the stereo flags, cbStWidthBuf describes the band boundaries of each stereo band, stGain represents the gain for each spectral stereo band, stFlags represents the state flags and thus the stereo image location for each band, and allZeros indicates whether all frequency bands use the same gain or whether there are frequency bands which have different gains. As can be seen, abrupt changes in time and frequency dimension are smoothed in case the stereo images move from CENTER to LEFT or RIGHT in the time dimension or in the frequency dimension.

In the HF decoder 63, the bitstream is decoded correspondingly, or in accordance with the second encoding scheme for the HF encoder 33 described above.

In the LF decoder 65, reverse operations to the LF encoder 35 are carried out to regain the transmitted quantized spectral samples. First, a flag bit is read to see whether non-zero spectral samples are present. If non-zero spectral samples are present, the quantizer gain is decoded. The value range for the quantizer gain is from minGain to minGain+63. Next, Huffman symbols are decoded and quantized samples are obtained.

The Huffman symbols are decoded by retrieving the corresponding Huffman index from the respective table and by converting the Huffman index to spectral samples in accordance with the following equation:

$$y=\lfloor hCbIdx/x\mathrm{Amp}\rfloor$$

$$z=hCbIdx-y\cdot x\mathrm{Amp} \tag{22}$$

Once the unsigned spectral samples are known, the sign bits are read for all non-zero samples. In case a differential coding was used for the samples, the subblock samples are reconstructed by adding the subblock samples from the previous superframe to the decoded samples.

Finally, the spectra is inverse quantized to obtain the reconstructed spectral samples as follows $$cCoef_{decoder}[i][j] = \mathrm{sign}(qCoef_{decoder}[i][j])\cdot|qCoef_{decoder}[i][j]|\cdot 2^{0.25\cdot qGain} \tag{23}$$

$$\mathrm{sign}(x)=\begin{cases}-1, & \text{if } x\le 0\\ 1, & \text{otherwise}\end{cases}$$

Equation (23) is repeated for $0\leqq i<N$ and $0\leqq j<M$, that is for all frequency bands and all frames.

If refinement information is present in addition, which is indicated by a refinement bit of '1', this information is taken into account as well in Equation (23).

Finally, the dequantized spectra is used to reconstruct the left and right channels at the low frequencies in accordance with the following equations:

$$\hat{L}_f[i][j]=\begin{cases}\hat{M}_f[i][j]+cCoef_{decoder}[i][j], & \text{if } cCoef_{decoder}[i][j]\,!=0\\ \hat{M}_f[i][j], & \text{otherwise}\end{cases} \tag{24}$$

$$\hat{R}_f[i][j]=\begin{cases}\hat{M}_f[i][j]-cCoef_{decoder}[i][j], & \text{if } cCoef_{decoder}[i][j]\,!=0\\ \hat{M}_f[i][j], & \text{otherwise}\end{cases}$$

where $\hat{M}_f$ is the decoded mono signal transformed to the frequency domain.

In order to ensure that there are no abrupt changes in the decoded signal, a smoothing is performed on a frame-by-frame basis based on the following equation:

$$sPanning=\begin{cases}\text{TRUE}, & \text{if sum} > 1.49 \text{ and count} > 3\\ \text{FALSE}, & \text{otherwise}\end{cases} \tag{25}$$

$$\text{sum}=0.25\cdot\sum_{j=0}^{4-1} midGain[j]$$

$$\text{count}=\sum_{j=0}^{4-1}\begin{cases}1, & \text{if } Lcount[j]==27 \text{ or } Rcount[j]==27\\ 0, & \text{otherwise}\end{cases}$$

$$Lcount[i]=\sum_{j=0}^{27-1}\begin{cases}1, & \text{if stFlags_mid}[i][j]==\text{LEFT}\\ 0, & \text{otherwise}\end{cases}$$

$$Rcount[i]=\sum_{j=0}^{27-1}\begin{cases}1, & \text{if stFlags_mid}[i][j]==\text{RIGHT}\\ 0, & \text{otherwise}\end{cases}$$

The smoothing steps can then be summarized with the following pseudo-code:

```
/*-- Decode each spectral line within the group. --*/
for(i = 0; i < 4; i++)
{
  hPanning[i] = 0;
  gLow = (1.0f / (FLOAT) pow(2.0f, 0.25 * 2.25));
  if(sPanning)
  {
    FLOAT gLow2, gLow3;
  if(panningFlag > 1)
  {
    hPanning[i] = (Lcount[i] == 27) ? RIGHT : LEFT;
    gLow = 1.0E−10f;
    for(j = 0; j < 32; j++)
      gLow += monoCoef[i][j] * monoCoef[i][j];
    gLow3 = gLow = gLow / 32;
    gLow = (FLOAT) (1.0f / pow(gLow, 0.03f));
    gLow2 = gLow;
    if(sum < 1.7f)
      gLow = (FLOAT) (1.0f / sum);
    else
    {
      gLow = (gLow + (1.0f / MAX(1.9f, sum))) * 0.5f;
      if((sum / gLow) > 4.8f)
        gLow = sum / 4.8f;
    }
  }
}
else if(hPanning[i] == 0)
{
    if(midGain[i] > 1.4f)
    {
      if(Lcount[i] >= (27 − 1) && Lcount[i] != 27)
        hPanning[i] = 2;
      else if(Rcount[i] >= (27 − 1) && Rcount[i] != 27)
        hPanning[i] = 1;
    if(hPanning[i])
        gLow = (FLOAT) (1.0f /
sqrt(sqrt(sqrt(midGain[i]))));
    }
  }
  if(hPanning[i])
  {
    if(sPanning)
      fadeIn = 4;
    else
      fadeIn = 3;
    if(prevGain != 0.0f)
      gLow = (gLow + prevGain) * 0.5f;
    else if(fadeValue != 0.0f)
      gLow = (gLow + fadeValue) * 0.5f;
    prevGain = gLow;
    fadeValue = gLow;
  }
  else prevGain = 0.0f;
  /*-- Inverse MS matrix. --*/
  for(j = 0; j < 32; j++)
  }
    FLOAT l, r;
    if(cCoef_decoder[i][j] != 0)
    {
      l = cCoef_decoder[i][j] + monoCoef[i][j];
      r = −cCoef_decoder[i][j] + monoCoef[i][j];
      leftCoef[j] = 1;
      rightCoef[j] = r;
    }
    if(hPanning[i] == LEFT)
      rightCoef[i] *= gLow;
    else if(hPanning[i] == RIGHT)
      leftCoef[j] *= gLow;
    else if(fadeIn)
    {
      rightCoef[j] *= fadeValue;
      leftCoef[j] *= fadeValue;
    }
  }
  fadeIn −= 1;
  fadeValue = sqrt(fadeValue);
  if(fadeIn < 0)
  {
```

-continued

```
      fadeIn = 0;
      fadeValue = 0.0f;
    }
  }
  if(sPanning)
  {
    panningFlag <<= 1;
    panningFlag |= 1;
  }
  else
  {
    panningFlag <<= 1;
    panningFlag |= 0;
  }
```

Here, fadeIn, fadeValue, panningFlag, and prevGain describe the smoothing parameters over time. These values are set to zero at the beginning of the decoding. MonoCoef is the decoded mono signal transferred to the frequency domain, and leftCoef and rightcoef are the output channels corresponding to left and right channels, respectively.

Now, the left and right channels have been fully reconstructed.

After the degrouping of the superframe by the degrouping portion 52, each frame in the superframe is subjected to an inverse transform by the IMDCT portions 50 and 51, respectively, to obtain the time domain stereo signals.

On the whole, the presented system ensures an excellent quality of the transmitted stereo audio signal with a stable stereo image over a wide bandwidth and thus a wide range of stereo content.

It is to be noted that the described embodiment constitutes only one of a variety of possible embodiments of the invention.

The invention claimed is:

1. Method comprising:

generating from a multichannel audio signal an encoded mono audio signal in a first processing chain; and generating from said multichannel audio signal encoded parametric multichannel extension information in a second processing chain distinct from said first processing chain, said generating of encoded parametric multichannel extension information comprising:

transforming each channel of said multichannel audio signal into the frequency domain;

dividing a bandwidth of said frequency domain channel signals into a first region of lower frequencies and at least one further region of higher frequencies; and encoding said frequency domain channel signals in each of said frequency regions with another type of coding to obtain a parametric multichannel extension information for the respective frequency region, wherein encoding said frequency domain signals in said first region comprises combining corresponding samples of all channels in said first region, quantizing said combined samples and encoding said quantized samples, and wherein encoding said quantized samples comprises dividing said quantized samples into subblocks and encoding each subblock separately.

2. Method according to claim 1, wherein encoding said quantized samples comprises applying a plurality of coding schemes to said quantized samples and selecting a coding scheme which results in a lowest number of bits for said parametric multichannel extension information.

3. Method according to claim 2, wherein said plurality of coding schemes comprise a plurality of Huffman coding schemes.

4. Method according to claim 1, wherein, in case encoding said quantized samples results in more bits for said parametric multichannel extension information than are available for said first region, said quantization comprises modifying said quantized samples to obtain quantized samples which result in said encoding of quantized samples at the most in the number of bits for said parametric multichannel extension information that are available for said first region.

5. Method according to claim 1, wherein said quantization employs a selectable quantization gain for quantizing combined samples of a respective frame, said quantization comprising selecting a quantization gain for a respective frame which avoids sudden changes in the quantization gain from one frame to the next.

6. Method according to claim 1, wherein in case encoding said quantized samples results in a number of bits for said parametric multichannel extension information which is lower than a number of bits which are available for said first region, said method further comprising generating refinement bits representing information which allows to compensate for quantization errors.

7. Method according to claim 1, wherein said at least one further region comprises a middle frequency region and a high frequency region.

8. Method according to claim 7, wherein said type of coding employed for encoding said frequency domain signals in said middle frequency region comprises:

determining for each of a plurality of adjacent frequency bands within said middle frequency region whether a spectral first channel signal of said multichannel signal, a spectral second channel signal of said multichannel signal or none of said spectral channel signals is dominant in the respective frequency band; and encoding a corresponding state information for each of said frequency bands as a parametric multichannel extension information.

9. Method according to claim 8, further comprising post-processing said determined state information such that short-time changes in said state information are avoided before encoding said state information.

10. Method according to claim 7, wherein said type of coding employed for encoding said frequency domain signals in said high frequency region comprises:

determining for each of a plurality of adjacent frequency bands within said high frequency region whether a spectral first channel signal of said multichannel signal, a spectral second channel signal of said multichannel signal or none of said spectral channel signals is dominant in the respective frequency band; and selecting a first approach or a second approach for encoding a corresponding state information for each of said frequency bands as a parametric multichannel extension information, wherein said first approach includes encoding a corresponding state information for each of said frequency bands, and wherein said second approach includes comparing said state information for a current frame to state information for a previous frame, encoding a result of this comparison and encoding state information for a current frame only in case there was a change in said state information from said previous frame to said current frame.

11. Method according to claim 10, further comprising post-processing said determined state information such that short-time changes in said state information are avoided before encoding said state information.

12. Method comprising:

decoding an encoded mono signal;

decoding an encoded parametric multichannel extension information which is provided separately for a first region of lower frequencies and for at least one further region of higher frequencies using different types of coding, wherein said encoded parametric multichannel extension information comprises for said first region encoded subblocks, said encoded subblocks having been obtained at an extension encoder by combining corresponding samples of all channels in said first region, quantizing said combined samples, dividing said quantized samples into subblocks and encoding each subblock separately;

reconstructing a multichannel signal based on said decoded mono signal and on said decoded parametric multichannel extension information separately for said first region and said at least one further region;

combining said reconstructed multichannel signals in said first and said at least one further region; and transforming each channel of said combined multichannel signal into the time domain.

13. Apparatus comprising:

an encoder configured to generate from a multichannel audio signal an encoded mono audio signal in a first processing chain; and an extension encoder configured to generate from said multichannel audio signal encoded parametric multichannel extension information in a second processing chain distinct from said first processing chain, said extension encoder comprising:

a transforming portion configured to transform each channel of a multichannel audio signal into the frequency domain;

a separation portion configured to divide a bandwidth of frequency domain channel signals provided by said transforming portion into a first region of lower frequencies and at least one further region of higher frequencies;

a low frequency encoder configured to encode frequency domain signals provided by said grouping portion for said first frequency region with a first type of coding to obtain a parametric multichannel extension information for said first frequency region, said low frequency encoder comprising a combining portion configured to combine corresponding samples of all channels in said first region, a quantization portion configured to quantize combined samples provided by said combining portion and an encoding portion configured to encode quantized samples provided by said quantization portion, wherein the encoding portion is configured to divide said quantized samples into subblocks and to encode each subblock separately; and at least one higher frequency encoder configured to encode frequency domain signals provided by said grouping portion for said at least one further frequency region with at least one further type of coding to obtain a parametric multichannel extension information for said at least one further frequency region.

14. Apparatus according to claim 13, wherein the encoding portion is configured apply a plurality of coding schemes to said quantized samples and to select a coding scheme which results in the lowest number of bits for said parametric multichannel extension information.

15. Apparatus according to claim 14, wherein said plurality of coding schemes comprise a plurality of Huffman coding schemes.

16. Apparatus according to claim 13, wherein said quantization portion is configured to modifying said quantized samples, in case encoding said quantized samples by said encoding portion results in more bits for said parametric multichannel extension information than are available for said first region, to obtain quantized samples which result in said encoding of quantized samples by said encoding portion at the most in the number of bits for said parametric multichannel extension information that are available for said first region.

17. Apparatus according to claim 13, wherein said quantization portion is configured to employ a selectable quantization gain for quantizing combined samples of a respective frame, and wherein said quantization portion is further configured to select a quantization gain for a respective frame which avoids sudden changes in the quantization gain from one frame to the next.

18. Apparatus according to claim 13, wherein said low frequency encoder further comprises a refinement portion which is configured to generate refinement bits representing information which allows to compensate for quantization errors in a quantization by said quantization portion, in case encoding said quantized samples by said encoding portion results in a number of bits for said parametric multichannel extension information which is lower than a number of bits which are available for said first region.

19. Apparatus according to claim 13, wherein said at least one higher frequency encoder comprises a middle frequency encoder configured to encode frequency domain signals in a middle frequency region and a high frequency encoder configured to encode frequency domain signals in a high frequency region.

20. Apparatus according to claim 19, wherein said middle frequency encoder comprises:

a processing portion configured to determine for each of a plurality of adjacent frequency bands within said middle frequency region whether a spectral first channel signal of said multichannel signal, a spectral second channel signal of said multichannel signal or none of said spectral channel signals is dominant in the respective frequency band and to provide for each frequency band a corresponding state information; and an encoding portion configured to encode state information provided by said processing portion to obtain a parametric multichannel extension information.

21. Apparatus according to claim 20, further comprising a post-processing portion configured to post-process state information determined by said processing portion such that short-time changes in said state information are avoided before said state information is encoded by said encoding portion.

22. Apparatus according to claim 19, wherein said high frequency encoder comprises:

a processing portion configured to determine for each of a plurality of adjacent frequency bands within said middle frequency region whether a spectral first channel signal of said multichannel signal, a spectral second channel signal of said multichannel signal or none of said spectral channel signals is dominant in the respective frequency band and to provide for each frequency band a corresponding state information; and an encoding portion configured to select and to apply a first approach or a second approach for encoding a state information provided by said processing portion to obtain a parametric multichannel extension information, wherein said first approach includes encoding a state information for each of said frequency bands provided by said processing portion, and wherein said second approach includes comparing state information provided by said processing portion for a current frame to state information provided by said processing portion for a previous frame, encoding a result of this comparison and encoding state information for a current frame only in case there was a change in said state information from said previous frame to said current frame.

23. Apparatus according to claim 22, further comprising a post-processing portion configured to post-process state information determined by said processing portion such that short-time changes in said state information are avoided before said state information is encoded by said encoding portion.

24. Apparatus according to claim 13, wherein said apparatus is one of a multichannel encoder and a mobile terminal.

25. Audio coding system comprising an apparatus according to claim 13 and an electronic device with a multichannel decoder, said multichannel decoder comprising a decoder configured to decode a provided encoded mono signal and an extension decoder, said extension decoder including:

a first decoding portion configured to decode an encoded parametric multichannel extension information which is provided for a first region of lower frequencies using a first type of coding, and to reconstruct a multichannel signal based on said decoded mono signal and on said decoded parametric multichannel extension information;

at least one further decoding portion configured to decode an encoded parametric multichannel extension information which is provided for at least one further region of higher frequencies using at least one further type of coding, and to reconstruct a multichannel signal based on said decoded mono signal and on said decoded parametric multichannel extension information;

a combining portion configured to combine reconstructed multichannel signals provided by said first decoding portion and said at least one further decoding portion; and a transforming portion configured to transform each channel of a combined multichannel signal into a time domain.

26. Apparatus comprising:

a decoder configured to decode a provided encoded mono signal; and an extension decoder including:

a first decoding portion configured to decode an encoded parametric multichannel extension information which is provided for a first region of lower frequencies using a first type of coding, wherein said encoded parametric multichannel extension information comprises encoded subblocks, said encoded subblocks having been obtained at an extension encoder by combining corresponding samples of all channels in said first region, quantizing said combined samples, dividing said quantized samples into subblocks and encoding each subblock separately, said first decoding portion being further configured to reconstruct a multichannel signal based on said decoded mono signal and on said decoded parametric multichannel extension information;

at least one further decoding portion configured to decode an encoded parametric multichannel extension information which is provided for at least one further region of higher frequencies using at least one further type of coding, and to reconstruct a multichannel signal based on said decoded mono signal and on said decoded parametric multichannel extension information;

a combining portion configured to combine reconstructed multichannel signals provided by said first decoding portion and said at least one further decoding portion; and a transforming portion configured to transform each channel of a combined multichannel signal into a time domain.

27. Apparatus according to claim 26, wherein said apparatus is one of a multichannel decoder and a mobile terminal.

28. Encoder in which a software code is stored, said software code realizing the following when running in a processing component of said encoder:

generating from a multichannel audio signal an encoded mono audio signal in a first processing chain; and generating from said multichannel audio signal encoded parametric multichannel extension information in a second processing chain distinct from said first processing chain, said generating of encoded parametric multichannel extension information comprising:

transforming each channel of said multichannel audio signal into the frequency domain;

dividing a bandwidth of said frequency domain channel signals into a first region of lower frequencies and at least one further region of higher frequencies; and encoding said frequency domain signals in each of said frequency regions with another type of coding to obtain a parametric multichannel extension information for the respective frequency region, wherein encoding said frequency domain signals in said first region comprises combining corresponding samples of all channels in said first region, quantizing said combined samples and encoding said quantized samples, and wherein encoding said quantized samples comprises dividing said quantized samples into subblocks and encoding each subblock separately.

29. Decoder in which a software code is stored, said software code realizing the following when running in a processing component of said decoder:

decoding an encoded mono signal;

decoding an encoded parametric multichannel extension information which is provided separately for a first region of lower frequencies and for at least one further region of higher frequencies, wherein said encoded parametric multichannel extension information comprises for said first region encoded subblocks, said encoded subblocks having been obtained at an extension encoder by combining corresponding samples of all channels in said first region, quantizing said combined samples, dividing said quantized samples into subblocks and encoding each subblock separately;

reconstructing a multichannel signal based on said decoded mono signal and on said decoded parametric multichannel extension information separately for said first region and said at least one further region;

combining said reconstructed multichannel signals in said first and said at least one further region; and transforming each channel of said combined multichannel signal into the time domain.

* * * * *

UNITED STATES PATENT AND TRADEMARK OFFICE

CERTIFICATE OF CORRECTION

PATENT NO. : 7,620,554 B2
APPLICATION NO. : 11/138711
DATED : November 17, 2009
INVENTOR(S) : Juha Ojanperä

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1202 days.

Signed and Sealed this

Twenty-sixth Day of October, 2010

David J. Kappos

David J. Kappos
*Director of the United States Patent and Trademark Office*